US009199256B2

(12) United States Patent
Jia et al.

(10) Patent No.: US 9,199,256 B2
(45) Date of Patent: Dec. 1, 2015

(54) MULTIFUNCTIONAL DISPENSER

(71) Applicant: Xiamen Runner Industrial Corporation, Xiamen (CN)

(72) Inventors: Wei-Jie Jia, Xiamen (CN); Can-Xiang Xu, Xiamen (CN); Wei-Qiang Xu, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 81 days.

(21) Appl. No.: 14/162,246

(22) Filed: Jan. 23, 2014

(65) Prior Publication Data

US 2014/0209706 A1 Jul. 31, 2014

(30) Foreign Application Priority Data

Jan. 29, 2013 (CN) ..... 2013 1 0033456

(51) Int. Cl.

| | |
|---|---|
| ***B05B 7/30*** | (2006.01) |
| ***B05B 7/32*** | (2006.01) |
| ***B05B 7/04*** | (2006.01) |
| ***B05B 7/24*** | (2006.01) |

(52) U.S. Cl.

CPC ..... *B05B 7/32* (2013.01); *B05B 7/0408* (2013.01); *B05B 7/2443* (2013.01); *B05B 7/30* (2013.01)

(58) Field of Classification Search

CPC ..... B05B 7/12; B05B 7/1209; B05B 7/1218; B05B 7/1227; B05B 7/244; B05B 7/2443; B05B 7/26; B05B 7/28; B05B 7/30; B05B 7/32; B05B 7/0408

USPC ..... 239/310, 315, 316, 317, 318, 413, 414, 239/415, 569, 574, 581.1, 581.2, 582.1, 583

See application file for complete search history.

(56) References Cited

U.S. PATENT DOCUMENTS 2,719,704 A * 10/1955 Anderson ..... A47L 15/4427 137/599.03
2,800,313 A * 7/1957 Targosh ..... A46B 11/066 15/29
3,940,069 A * 2/1976 Gunzel, Jr. ..... B05B 7/12 222/331
6,708,901 B2 * 3/2004 Hubmann ..... B01F 5/0413 239/310
6,988,675 B2 * 1/2006 Hubmann ..... B01F 5/0413 239/302
7,086,610 B2 * 8/2006 Hubmann ..... B05B 7/2443 239/302
7,341,207 B2 * 3/2008 Hubmann ..... B05B 7/2443 239/307
7,566,013 B2 * 7/2009 MacLean-Blevins .... B05B 7/12 239/310
7,661,604 B1 * 2/2010 MacLean-Blevins B05B 1/3026 222/566
8,069,878 B2 * 12/2011 Laible ..... A01C 23/042 137/892
8,177,143 B2 * 5/2012 Laible ..... B05B 7/1209 239/310
8,622,320 B2 * 1/2014 Plantz ..... B01F 5/0413 239/302
8,998,111 B2 * 4/2015 Sun ..... B05B 1/3013 239/302

* cited by examiner

*Primary Examiner* — Christopher Kim
(74) *Attorney, Agent, or Firm* — Chun-Ming Shih

(57) ABSTRACT

A multifunctional dispenser includes a main body having a connecting nozzle and a water supply pipe. A control valve, a regulating device, a proportional control device and a ventilation valve are on the main body. The bottom of main body communicates with a container through the proportional control device. The control valve determines the water flow of the water supply channel. The regulating device is a rotating cylinder passing through the main body. The cylinder has a valve track and a proportional controller track corresponding to the control valve and the proportional control device respectively. The valve track includes arc sections with unequal depths. The proportional controller track includes grooves with unequal depths and supports the proportional control device. A proportional regulator of the proportional control device has liquid outlet holes. The control valve controls the ventilation valve to open/close a gas inlet channel of a concentrated liquid container.

19 Claims, 34 Drawing Sheets

MULTIFUNCTIONAL DISPENSER

BACKGROUND OF THE INVENTION

1. Field of Invention

The present invention generally relates to a dispenser for diluting a concentrated chemical solution, and more particularly to a multifunctional dispenser capable of preparing chemical solution and regulating the chemical solution to various different concentrations.

2. Description of Related Art

In general, a cleaning and washing site requires diluting a chemical cleaning agent in order to achieve the effects of cleaning and disinfection. Since a large cleaning and washing site needs lots of washing solution, and manually diluting the chemical concentrated liquid cannot satisfy the requirement, therefore a chemical concentrated liquid container is connected to a water supply pipe directly, and a dispenser capable of synchronously diluting the chemical concentrated liquid during use brings tremendous convenience to the aforementioned large cleaning and washing site. At present, a regulating dispenser primarily regulates the status of liquid sprayed out from a nozzle, and thus it is an important subject of the present invention to regulate the flow and concentration of the sprayed liquid conveniently.

SUMMARY OF THE INVENTION

Therefore, it is a primary objective of the present invention to overcome the problems of the prior art by providing a multifunctional dispenser capable of mixing a liquid (or water) with a chemical concentrate in a container and dispensing the mixed solution, so that mixtures with different concentrations can be obtained at high and low velocities of flow respectively, and an accurate dispersion function can be achieved.

To achieve the foregoing objective, the present invention provides a multifunctional dispenser, comprising: a main body having a control valve, a regulating device, a proportional control device and a ventilation valve disposed thereon; a connecting nozzle, disposed at the front of the main body; a water supply pipe, disposed at the rear of the main body, wherein the bottom of the main body is communicated with a draft tube in a concentrated liquid container through the proportional control device, and the control valve is provided for determining the water flow condition of a water supply channel in the main body during a movement stroke of the main body, and the regulating device is a rotatable cylinder passing through the main body, and the cylinder has a valve track and a proportional controller track formed at positions corresponding to the control valve and the proportional control device respectively, and the valve track has a plurality of arc sections with unequal depths for limiting the stroke of the control valve, and the proportional controller track is in a wavy shape comprised of grooves with unequal depths; and a proportional regulator of the proportional control device abuts against the proportional controller track through a reset spring, and the proportional regulator having a plurality of liquid outlet holes together with different grooves formed on the proportional controller track are provided for determining the flow of the concentrated liquid outputted from the main body; and the main body further includes a ventilation valve for controlling the control valve to determine whether or not to open a gas inlet channel of the concentrated liquid container.

A valve chamber of the control valve is formed in a longitudinal direction inside the main body, and both sides of the valve chamber are communicated and coupled to the a water inlet channel of the water supply pipe and a water outlet channel of the connecting nozzle respectively, and a liquid output channel is formed on a sidewall of the valve chamber under the water outlet channel, and a base chamber corresponding to the regulating device is communicated with the main body and formed at the bottom of the valve chamber and a liquid input channel is formed on a sidewall of the base chamber and communicated with the container at the bottom of the main body; and the main body includes a gas inlet channel corresponding to the ventilation valve formed thereon and passing through the main body.

The control valve includes a press handle pivotally coupled to the top of the main body, a valve plug element disposed at a corresponding position in the valve chamber. The valve plug element includes a bolt shaft, a bolt seat for positioning the bolt shaft and a reset spring. After the valve plug element is assembled into the valve chamber of the main body, the bolt shaft is acted by the restoring spring to abut against a lower surface of the press handle.

The front of the press handle is pivotally coupled to the main body at the front of the valve chamber, and a top pressing surface is formed at the top of the press handle, and the top pressing surface has a long corresponding slot provided for installing a locking element, and the bottom of the locking element is movably installed on the main body to define a locking relation with the press handle.

The regulating device is a cylinder sealed in a base chamber of the main body, and a knob is formed at the front of the regulating device and extended out from the main body, and the cylinder at the rear of the knob is extended into the base chamber, and the cylinder includes a valve track and a proportional controller track formed at positions corresponding to the bolt shaft of the control valve and the proportional controller of the proportional control device respectively.

The valve track includes a sink slot formed radially along the cylinder, and further includes a shallow arc groove, a deep arc groove and an outer arc section with the same diameter of the base chamber formed at the external periphery of the cylinder.

The proportional controller track includes two deep slots, two shallow slots and two positioning slots formed radially along the cylinder.

The proportional control device includes a proportional regulator, a restoring spring and a connecting base, wherein the proportional regulator and the restoring spring are disposed in the connecting base and communicated with the draft tube in the container, and the proportional regulator is a bullet head having a sink hole and includes a plurality of liquid outlet hole formed in a longitudinal direction on a sidewall of the proportional regulator and communicated with the sink hole.

The ventilation valve includes a valve stem and a valve stem restoring spring, wherein a ventilation slot is formed on a sidewall of the valve stem, and the bottom of the valve stem is corresponsive to the sealing member to define a sealing relation with a stair at the top of the gas inlet channel.

The connecting nozzle includes a connecting pipe, a water mixing base, a locking sleeve and a nozzle, wherein a water outlet and a liquid outlet are disposed at positions corresponding to the rear of the connecting pipe and coupled to the water outlet channel and the liquid output channel of the main body respectively, and the front of the connecting pipe is disposed in the water mixing base and coupled to the nozzle at the front of the water mixing base, and the locking sleeve is provided for locking the connecting pipe and the water mixing base onto the main body.

The main body includes a valve chamber formed downwardly from the top of the main body and corresponding to the control valve, and both sides of the valve chamber are communicated to a water inlet channel of the water supply pipe and a water outlet channel of the connecting nozzle respectively, and a base chamber is formed transversally on the main body under the water outlet channel and corresponding to the regulating device, and a liquid output channel is disposed at the top of the base chamber and communicated with the water outlet channel, and a liquid input channel is disposed on a sidewall of the bottom of the base chamber and communicated with the container at the bottom of the main body, and a notch is formed at the top of an outer end of the base chamber, and the main body further includes a gas inlet channel formed in a longitudinal direction at the front of the base chamber and passed through the main body to correspond to the ventilation valve.

The control valve includes a press handle pivotally coupled to the top of the main body, a valve plug element disposed in the valve chamber. The valve plug element includes a bolt shaft, a bolt seat for positioning the bolt shaft and a reset spring. After the valve plug element is combined into the valve chamber of the main body, the bolt shaft is acted by the restoring spring to abut a lower surface of the press handle.

The lower front portion of the press handle is pivotally coupled to the main body at the front of the base chamber, and the top of the press handle has a top pressing surface, and a long corresponding slot formed on the top pressing surface and provided for installing a locking element. The bottom of the locking element is movably installed on the main body to define a locking relation with the press handle. The limit lug is formed on both sides of the press handle, and the position of the limit lug is aligned precisely with the notch formed at the top of the base chamber of the main body.

The regulating device is a cylinder sealed into the base chamber of the main body and includes a knob formed at the front of the regulating device and extended to the outside of the main body, and the cylinder at the rear of the knob is extended into the base chamber, and the cylinder has a valve track and a proportional controller track corresponding to the position of the limit lug of the control valve and the position of the proportional controller of the proportional control device respectively.

The valve track is disposed next to the knob, and a shallow arc groove, a deep arc groove and an outer arc section with the same diameter of the base chamber are formed at the external periphery of the cylinder.

The proportional control device includes a proportional regulator, a restoring spring and a connecting base, and the proportional regulator and the restoring spring are disposed in the connecting base and communicated with a draft tube in the container, and the proportional regulator has a bullet head of a sink hole, and a plurality of liquid outlet holes communicated with the sink hole and formed in a longitudinal direction on a sidewall of the proportional regulator.

The ventilation valve includes a sliding sleeve and a sliding sleeve spring in the water outlet channel, and the sliding sleeve has an air hole gasket and a liquid outlet gasket corresponding to the gas inlet channel and the liquid output channel of the main body respectively, and the sliding sleeve and the press handle are corresponsive to each other and operated together with the operation of the press handle.

The sliding sleeve includes a hook formed at the front of the slide sleeve and corresponsive to the front of the press handle.

With the aforementioned solution, the dispenser of the present invention can set an ON/OFF status of the dispenser through a regulating device having a valve track and a proportional controller track to output water with different flows and concentration ratios. The regulating device is provided for controlling the control valve to open or close the water supply channel and limit the flow while controlling the proportional control device to output a certain quantity of concentrated liquid, so as to achieve the effects of mixing a liquid (water) with a chemical concentrate in a container and distributing the mixed solution, and mixtures of different concentrations can be obtained in at both high-speed or low-speed flow and distributed accurately to meet the requirements for different occasions.

BRIEF DESCRIPTION OF THE DRAWINGS

The technical characteristics and objectives of the present invention can be further understood by the following detailed description of preferred embodiments and related drawings in which.

DETAILED DESCRIPTION OF THE INVENTION

Figure 1:
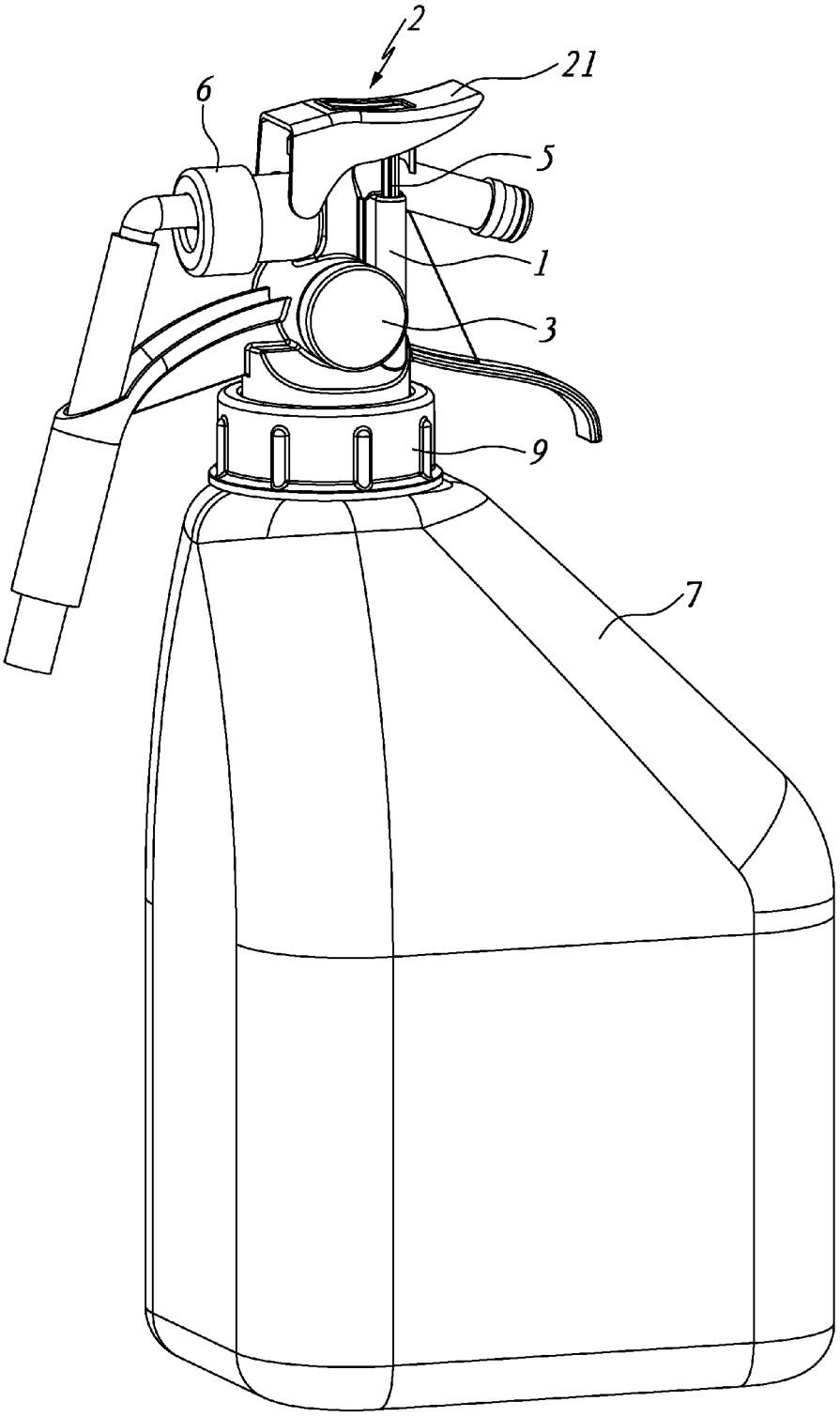
FIG. 1 is a perspective view of a first preferred embodiment of the present invention.
Figure 2:
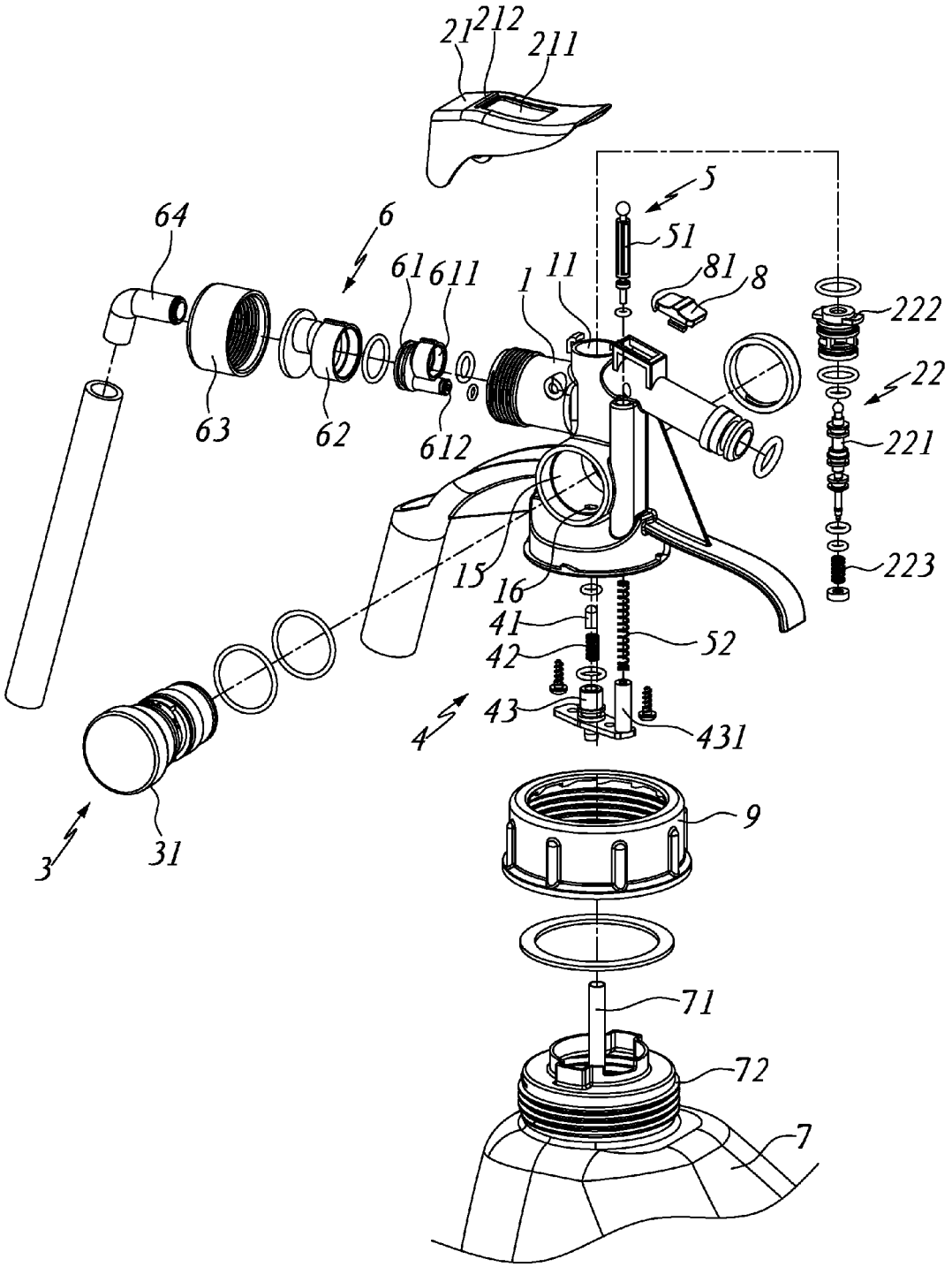
FIG. 2 is an exploded view of the first preferred embodiment of the present invention.

With reference to FIGS. 1 to 24B for a multifunctional dispenser of the present invention, the multifunctional dispenser is installed at a mouth portion of a chemical concentrated liquid container and connected to a water supply pipe for spraying water or a diluted solution. The dispenser comprises: a main body 1 having a control valve 2, a regulating device 3, a proportional control device 4 and a ventilation valve 5 disposed on the main body 1; a connecting nozzle 6, disposed at the front of the main body 1; a water supply pipe, disposed at the rear of the main body 1, wherein the bottom of the main body 1 is communicated with a draft tube 71 in the concentrated liquid container 7 through the proportional control device 4; and the control valve 2 is provided for determining the water flow condition of a water supply channel in the main body 1 during a movement stroke of the main body 1; and the regulating device 3 is a cylinder passing through the main body, and the cylinder has a valve track 32 and a proportional controller track 33 formed at positions corresponding to the control valve 2 and the proportional control device 4 respectively; and the valve track 32 has a plurality of arc sections with unequal depths for limiting the stroke of the control valve 2, and the proportional controller track 33 is in a wavy shape comprised of a plurality of grooves with unequal depths; and a proportional regulator 41 of the proportional control device 4 abuts against the proportional controller track 33 through a reset spring 42, and the proportional regulator 41 having a plurality of liquid outlet holes together with different grooves formed on the proportional controller track 33 are provided for determining the flow of the concentrated liquid outputted from the main body 1; and the main body 1 further includes a ventilation valve 5 for controlling the control valve 2 to determine whether or not to open a gas inlet channel 17 of the concentrated liquid container 7.

First Preferred Embodiment

With reference to FIGS. 1 to 12B for a multifunctional dispenser of the first preferred embodiment of the present invention, the multifunctional dispenser comprises a main body 1 having a control valve 2, a regulating device 3, a proportional control device 4 and a ventilation valve 5 disposed on the main body 1; a connecting nozzle 6 disposed at the front of the main body 1; a water supply pipe disposed at the rear of the main body 1; and a concentrated liquid container 7 coupled to the bottom of the main body 1.

Figure 6A:
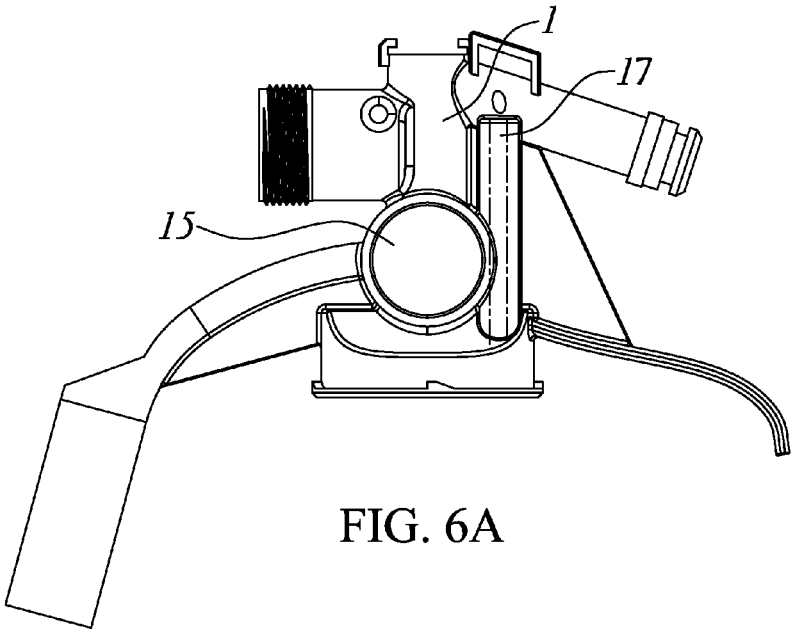
FIG. 6A is a main view of a main body of a dispenser of the first preferred embodiment of the present invention.
Figure 6B:
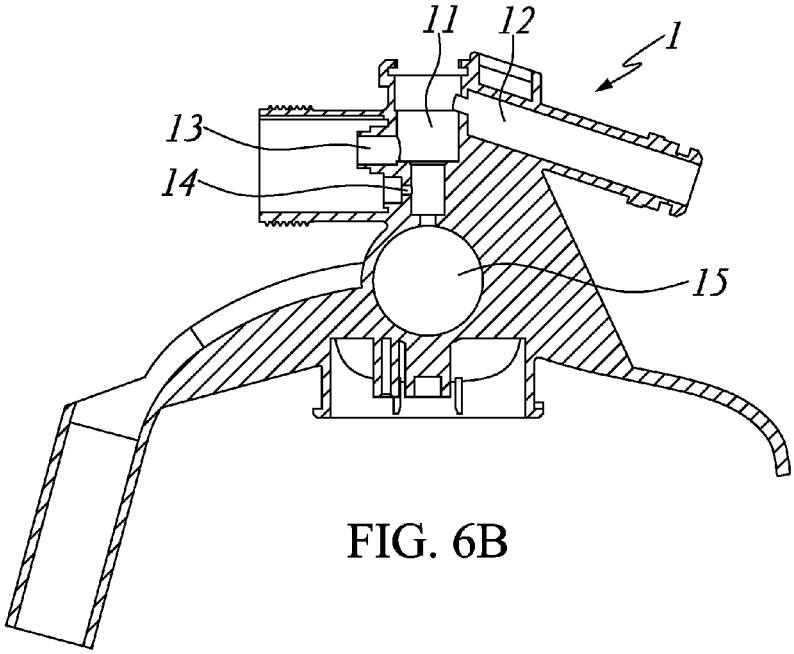
FIG. 6B is a longitudinal sectional view of a main body of a dispenser of the first preferred embodiment of the present invention.
Figure 6C:
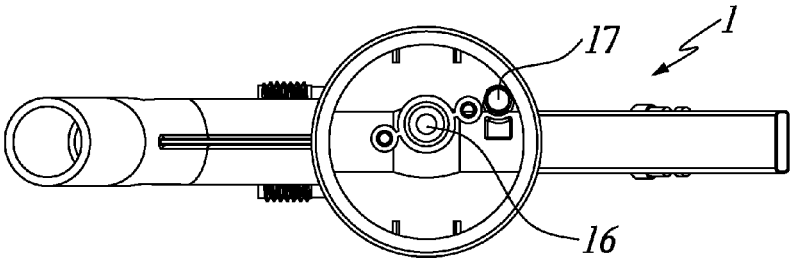
FIG. 6C is a bottom view of a main body of a dispenser of the first preferred embodiment of the present invention.

In FIGS. 6A and 6B, the main body 1 includes a valve chamber 11 formed in a longitudinal direction and corresponding to the control valve 2, and both sides of the valve chamber 11 are communicated and coupled to the water inlet channel 12 of the water supply pipe 7 and the water outlet channel 13 of the connecting nozzle 6 respectively. A liquid output channel 14 is formed on a sidewall of the valve chamber 11 at the bottom of the water outlet channel 13. The bottom of the valve chamber 11 is communicated with a base chamber 15 formed in a transverse direction on the main body 1 and corresponding to the regulating device 3. A liquid input channel 16 is formed on a sidewall of the base chamber 15 and communicated with the container 7 at the bottom of the main body 1. In addition, the main body 1 further includes a gas inlet channel 17 formed in a longitudinal direction at the rear of the valve chamber 11 and passing through the main body 1 and corresponding to the ventilation valve 5.

The control valve 2 includes a press handle 21 pivotally coupled to the top of the main body 1, a valve bolt module 22 disposed at a corresponding position in the valve chamber 11 and including a bolt shaft 221, a bolt seat 222 for positioning the bolt shaft 221 and a restoring spring 223. After the valve plug element 22 is assembled into the valve chamber 11 of the main body 1, the bolt shaft 221 is acted by the restoring spring 223 to abut against a lower surface of the press handle 21, and the press handle 21 applies a downward force to push the bolt shaft 221 to move downwardly in the valve chamber 11 to open the water supply channel and the liquid supply channel.

The bottom at the front of the press handle 21 is pivotally coupled to the main body 1 at the front of the valve chamber 11, and a top pressing surface is disposed at the top of the press handle 21, and the top pressing surface has a long corresponding slot 211 provided for installing a locking element 8. The bottom of the locking element 8 is movably installed on the main body 1 to define a locking relation with the press handle 21. In this embodiment, the front of the locking element 8 is latched along a front edge 81 into a latch groove 212 at the front of the corresponding slot 211 to achieve the locking effect.

Figure 3:
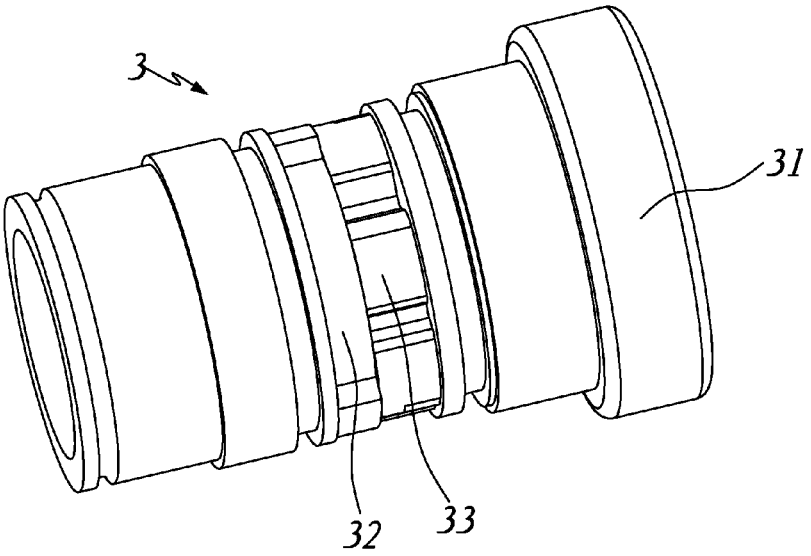
FIG. 3 is a perspective view of a regulating device of the first preferred embodiment of the present invention.
Figure 4A:
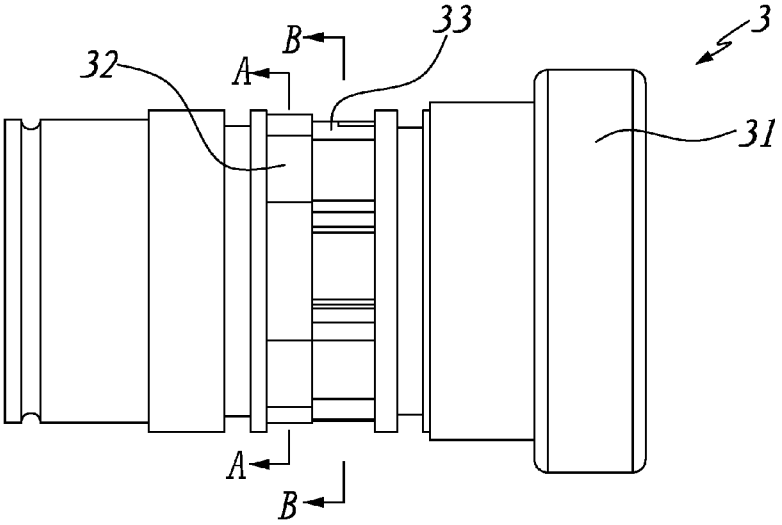
FIG. 4A is a main view of a regulating device of the first preferred embodiment of the present invention.
Figure 4B:
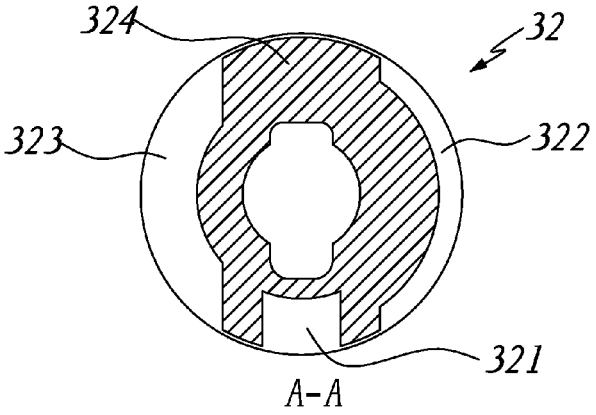
FIG. 4B is a sectional view of Section A-A of FIG. 4A.

In FIG. 3 to FIG. 4B, the regulating device 3 is a cylinder sealed into the base chamber 15 of the main body 1, and a knob 31 is formed at the front of the regulating device 3 and extended out from the main body 1, and the cylinder at the rear of the knob 31 is extended into the base chamber 15, and the cylinder has a valve track 32 and a proportional controller track 33 disposed at positions corresponding to the control valve 2 and the proportional control device 4 respectively.

In FIG. 4B, the valve track 32 has a sink slot 321 formed in a radial direction along the cylinder, and a shallow arc groove 322, a deep arc groove 323 and an outer arc section 324 with the same diameter of the base chamber 15 formed at the external periphery of the cylinder, wherein the sink slot 321, the shallow arc groove 322, the deep arc groove 323 and the outer arc section 324 determine the movable depth of the control valve 2 in a longitudinal direction of the bolt shaft 221.

Figure 4C:
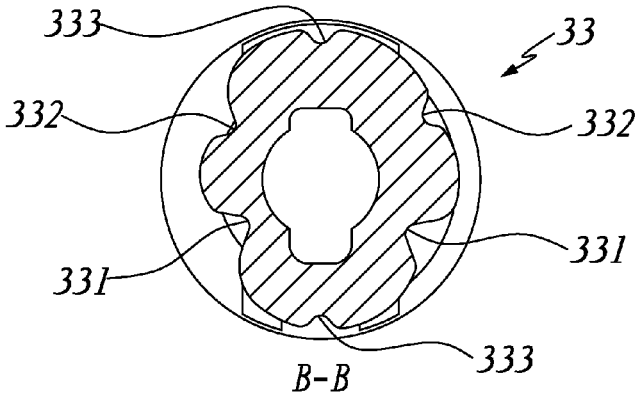
FIG. 4C is a sectional view of Section B-B of FIG. 4B.

In FIG. 4C, the proportional controller track 33 has a plurality of grooves formed in a radial direction along the cylinder, and two adjacent grooves are connected by an arc to define a wavy shape with different depths at different positions of the whole proportional controller track 33. In this preferred embodiment, there are two deep slots 331, two shallow slots 332 and two positioning slots 333, but the invention is not limited to such arrangements only, and the depth of the groove determines the outputted quantity of concentrated liquid controlled by the proportional control device 4, and the quantity of grooves determines the concentration, and thus the quantity of grooves can be adjusted to change the level of concentration.

Figure 5A:
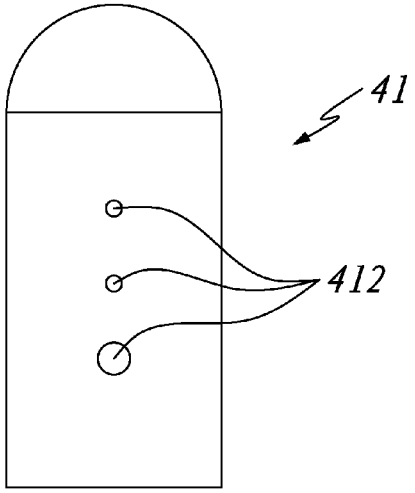
FIG. 5A is a main view of a proportional regulator of the first preferred embodiment of the present invention.
Figure 5B:
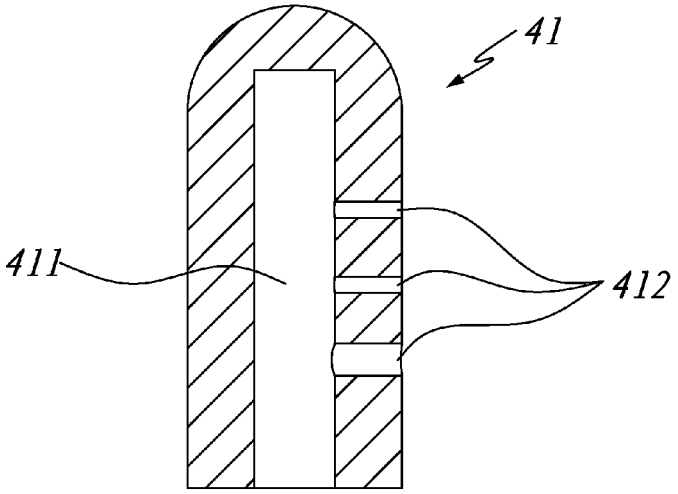
FIG. 5B is sectional view of a proportional regulator of the first preferred embodiment of the present invention.

In FIGS. 5A and 5B, the proportional control device 4 includes a proportional regulator 41, a restoring spring 42 and a connecting base 43, wherein the proportional regulator 41 and the restoring spring 42 are installed in the connecting base 43 and communicated with a draft tube 71 in the container 7, and the proportional regulator 41 pressed by the restoring spring 42 always abuts against the proportional controller track 33. The proportional regulator 41 is a bullet head having a sink hole 411, a plurality of liquid outlet holes 412 formed in a longitudinal direction on a sidewall of the proportional regulator 41 and communicated with the sink hole. In this preferred embodiment, there are three liquid outlet holes 412 formed in the longitudinal direction, and the quantity and size of the liquid outlet holes 412 determines the quantity of concentrated liquid outputted from the container 7.

The ventilation valve 5 includes a valve stem 51 and a valve stem restoring spring 52, and ventilation slot 511 is formed on a sidewall of the valve stem 51, and the bottom of the valve stem 51 is sealed to a stair at the top of the gas inlet channel 17 through the sealing member. In other words, the valve stem 51 is separated from the stair of the gas inlet channel 17 to facilitate opening the gas inlet channel 17, and the valve stem restoring spring 52 and the valve stem 51 are installed into the gas inlet channel 17 sequentially, and the valve stem restoring spring 52 always abuts against the lower surface at the rear of the press handle 21. In this preferred embodiment, the bottom of the restoring spring 52 abuts a column 431 on the connecting base 43, and the column 431 has a through hole to allow the gas inlet channel 17 to communicate with an internal cavity of the container 7.

The spray head 6 includes a connecting pipe 61, a water mixing base 62, a locking sleeve 63 and a nozzle 64, wherein a water outlet 611 and a liquid outlet 612 are formed at the rear of the connecting pipe 61 and coupled to the water outlet channel 13 and the liquid output channel 14 of the main body 1 respectively, and the front of the connecting pipe 61 is installed in the water mixing base 62, and the front of the water mixing base 62 is coupled to the nozzle 64, and the locking sleeve 63 is provided for locking the connecting pipe 61 and the water mixing base 62 onto the main body 1.

A mouth of the container 7 is sealed with the bottom of the main body 1 through a locking nut 9, while the proportional control device 4 is installed in the main body 1.

Figure 7A:
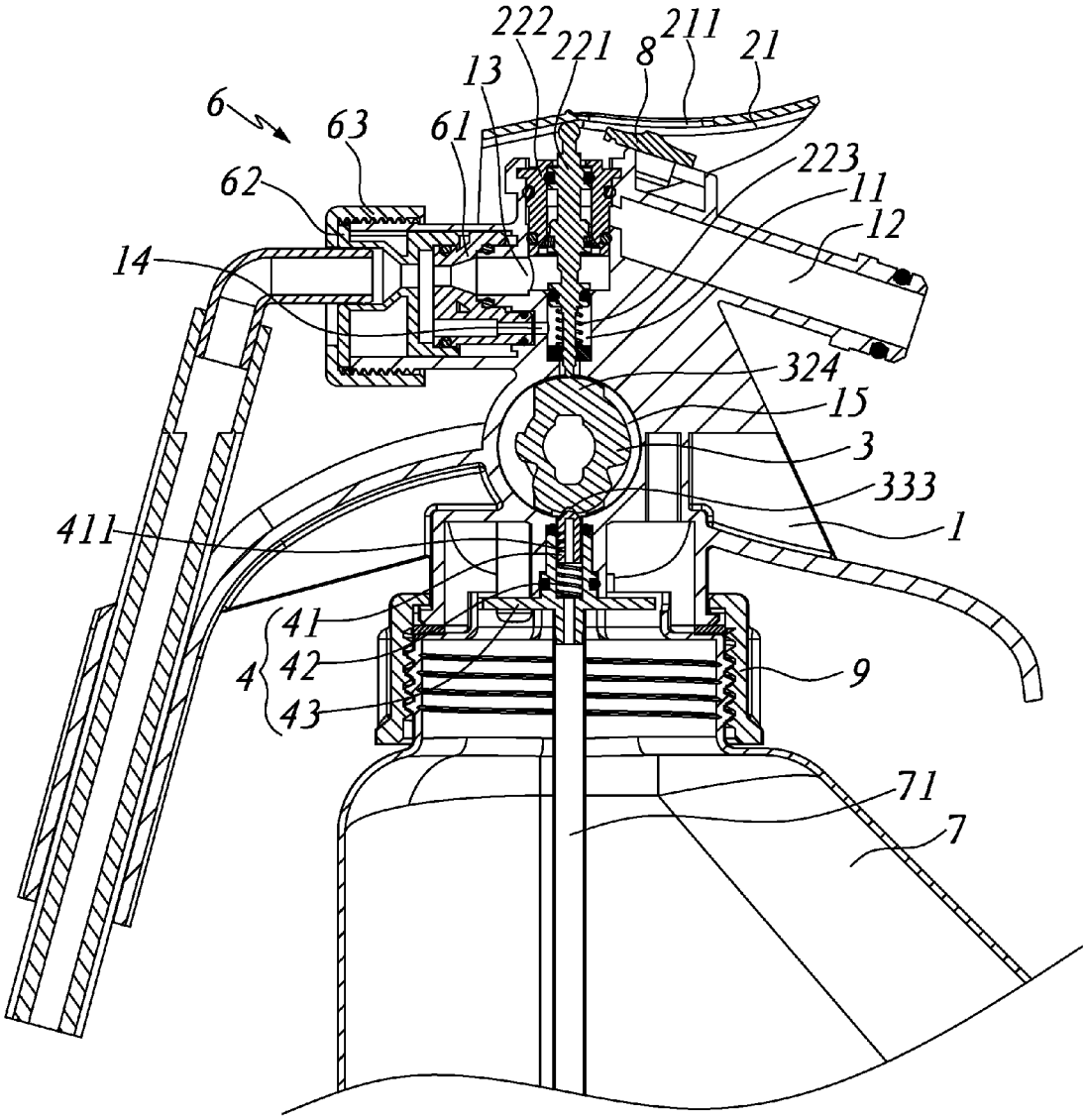
FIG. 7A is a sectional view, showing the position of a valve plug element (in a fully closed status) of the first preferred embodiment of the present invention.
Figure 7B:
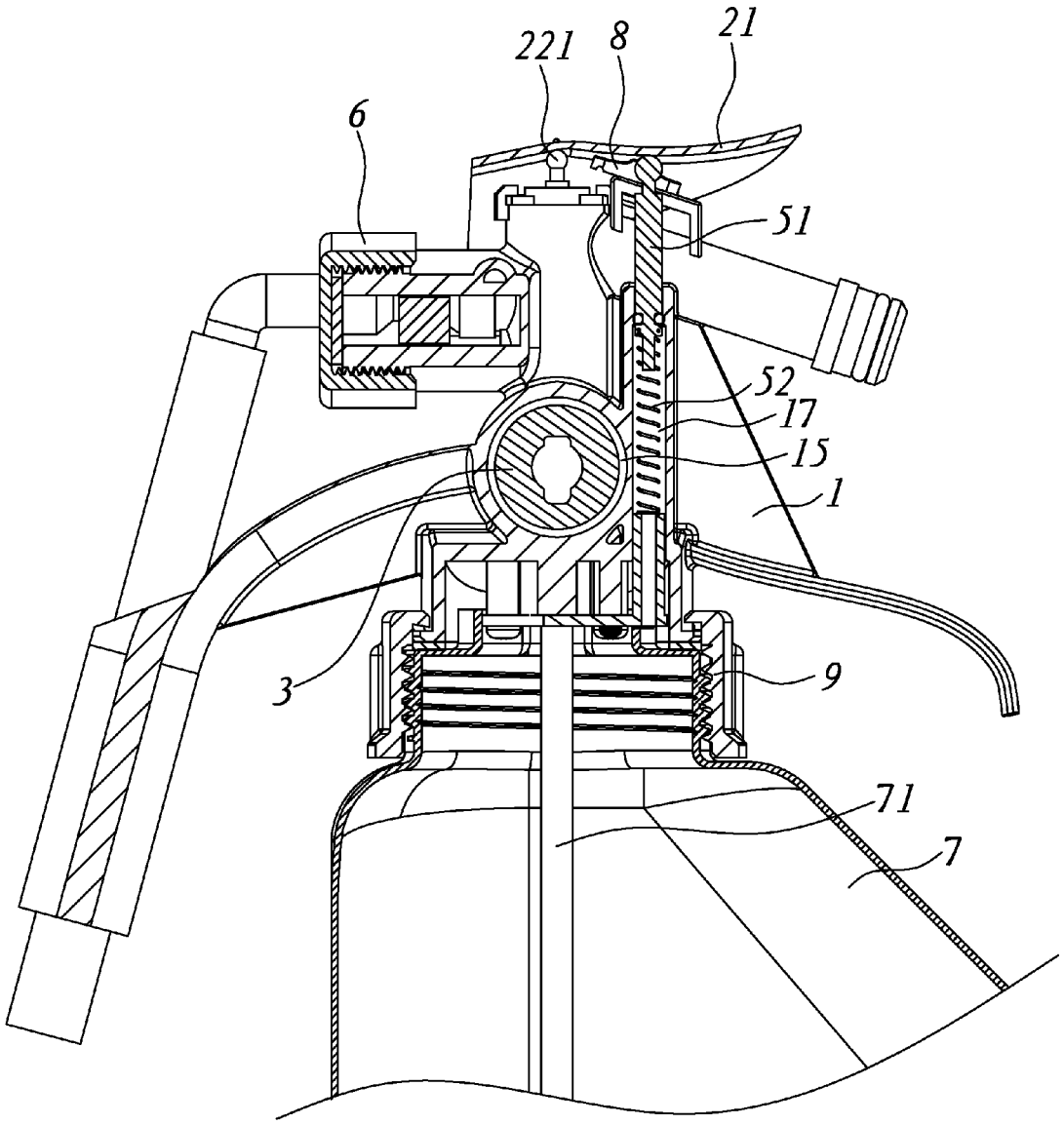
FIG. 7B is a sectional view, showing the position of a ventilation valve (in a fully closed status) of the first preferred embodiment of the present invention.

The specific operation modes of the first preferred embodiment of the present invention are described as follows:

In FIGS. 7A and 7B, when the knob 31 for rotating the regulating device 3 is set to an OFF status, the outer arc section 324 of the valve track 32 is situated on the top of the base chamber 15 and at a position opposite to the valve chamber 11. In the meantime, the positioning slot 333 of the proportional controller track 33 is disposed on the bottom of the base chamber 15 and at a position opposite to the liquid input channel 16, and the top of the proportional regulator 41 is disposed at the positioning slot 333, and the liquid outlet hole 412 of the proportional regulator 41 is disposed outside the base chamber 15 and limited by the outer arc section 324. Now, the bolt shaft 221 has no room for moving downward, so that the press handle 21 cannot be pressed, and both water supply channel and liquid supply channel of the dispenser are situated at the OFF status. As a result, no water or mixture can be outputted, and the dispenser is situated at a non-working status. Such arrangement can prevent leakage and facilitates the transportation and storage of the dispenser containing the concentrated liquid.

Figure 8A:
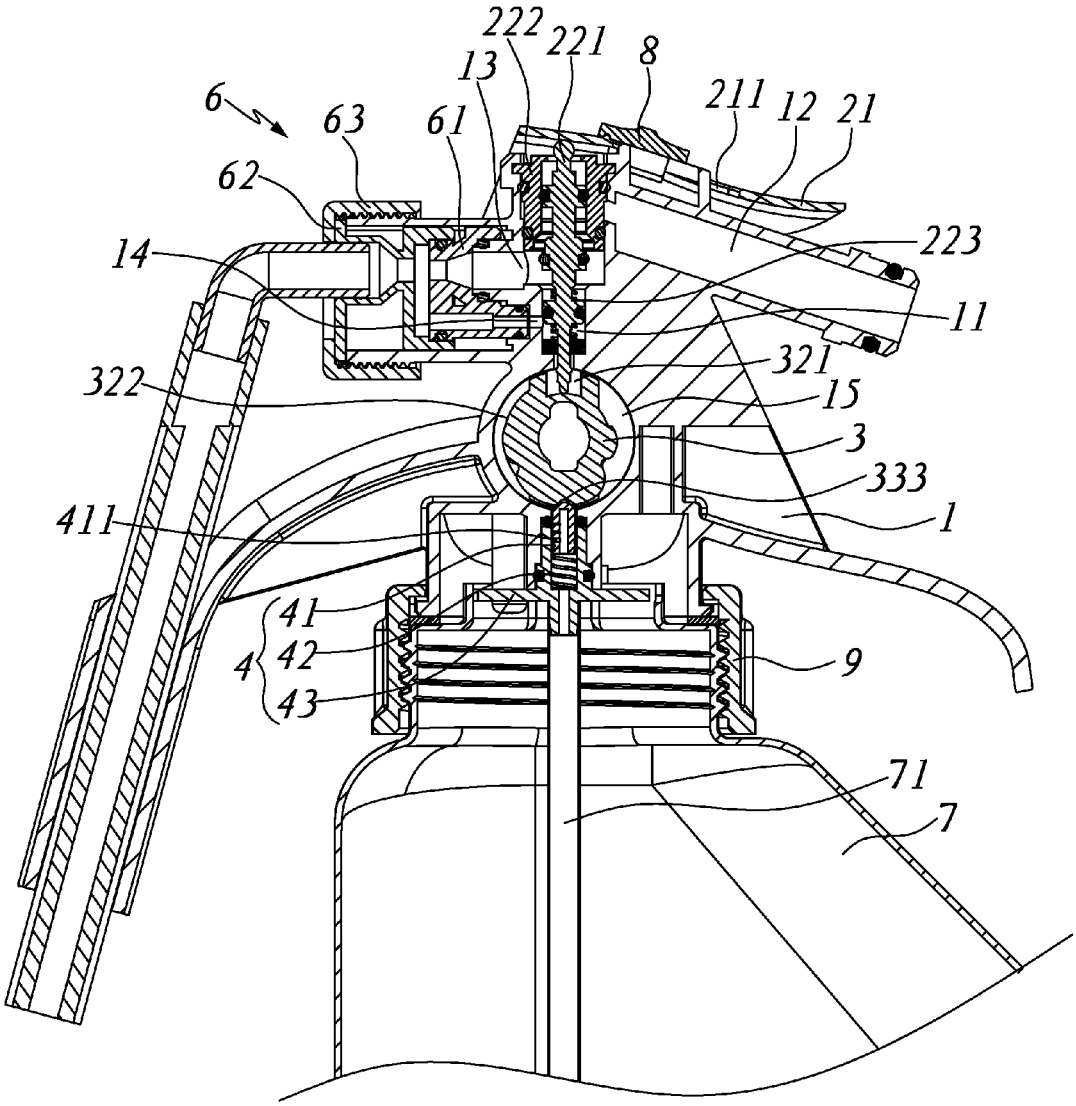
FIG. 8A is a sectional view, showing the position of a valve plug element (only at a water output status) of the first preferred embodiment of the present invention.
Figure 8B:
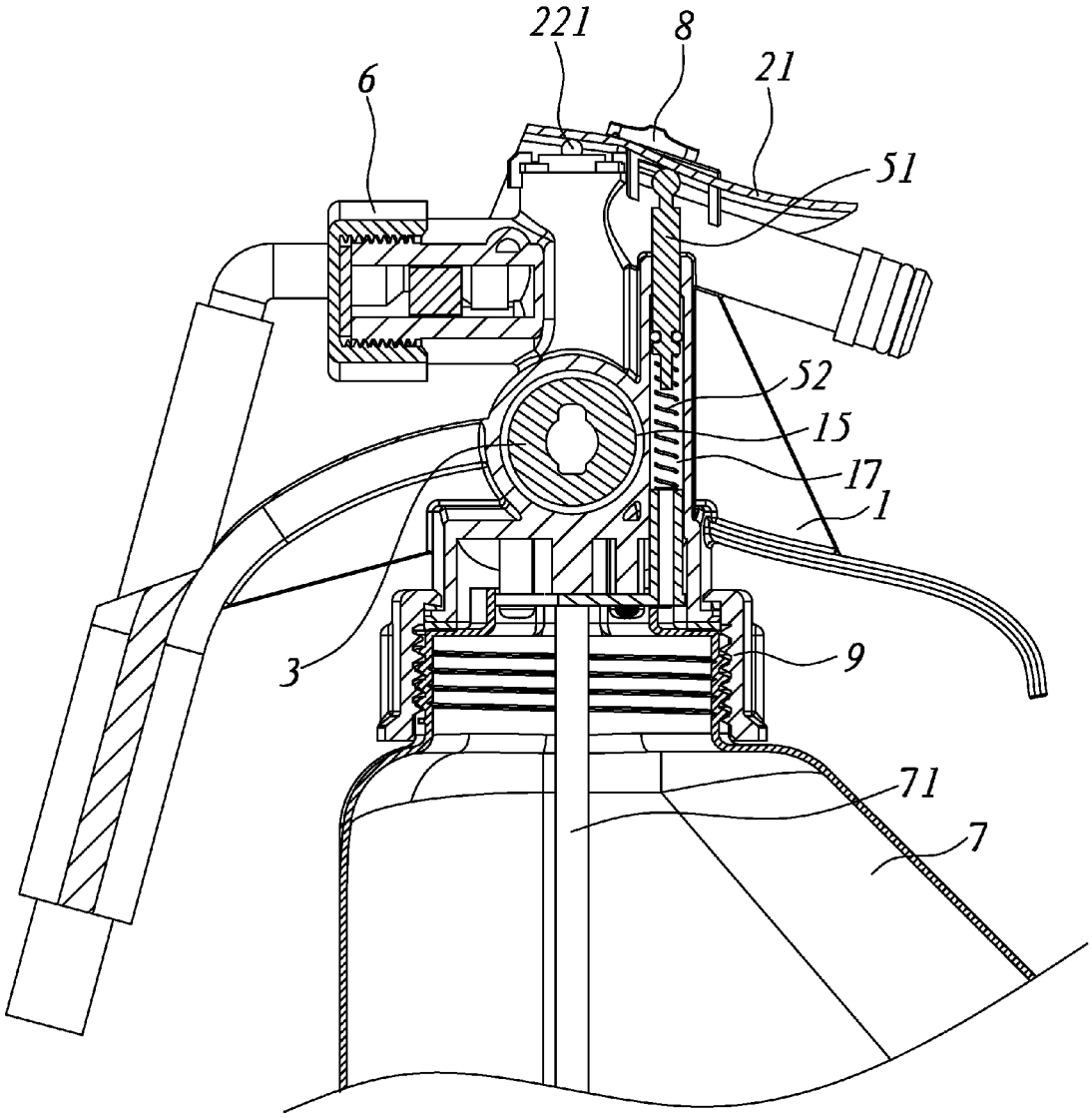
FIG. 8B is a sectional view, showing the position of a ventilation valve (only in a water output status) of the first preferred embodiment of the present invention.

In FIGS. 8A and 8B, when the knob 31 for rotating the regulating device 3 is set to a water output status only, the sink slot 321 of the valve track 32 is situated on the top of the base chamber 15 and at a position opposite to the valve chamber 11. In the meantime, another positioning slot 333 of the proportional controller track 33 is disposed on the bottom of the base chamber 15 and at a position opposite to the liquid input channel 16, and the top of the proportional regulator 41 abuts the positioning slot 333, and the liquid outlet hole 412 of the proportional regulator 41 is disposed outside the base chamber 15. In other words, the concentrated liquid cannot be drained out, and the liquid supply channel is situated at a closed status. Now, the press handle 21 can be pressed to push the bottom of the bolt shaft 221 to move towards the sink slot 321 in order to open the water supply channel of the dispenser, and the restoring spring 223 is situated at a compressed energy storage status. Now, the nozzle 64 sprays water only. If the press handle 21 is released, the bolt shaft 221 will restore its original position to close the water supply channel. To save power and effort of the operation, the dispenser keeps outputting water. After the press handle 21 is pressed to push the locking element 8 to latch the press handle 21, the press handle 21 is limited and cannot restore its original position, so that the dispenser can continue the water output without the need of applying force to the press handle 21. On the other hand, the effect of restoring the original position of the press handle 21 can be achieved.

Figure 9A:
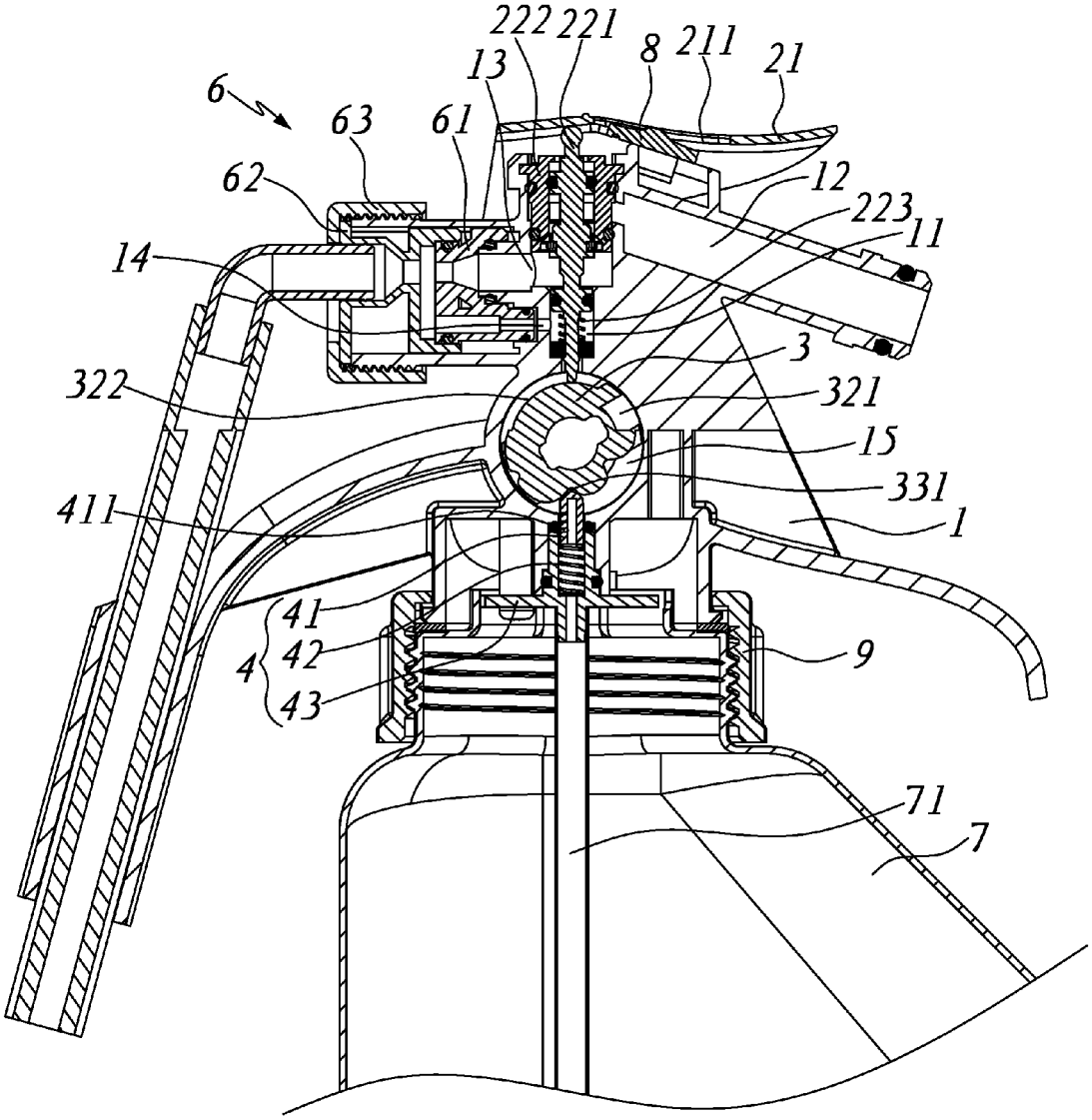
FIG. 9A is a sectional view, showing the position of a valve plug element (in a small-flow low-concentration status) of the first preferred embodiment of the present invention.
Figure 9B:
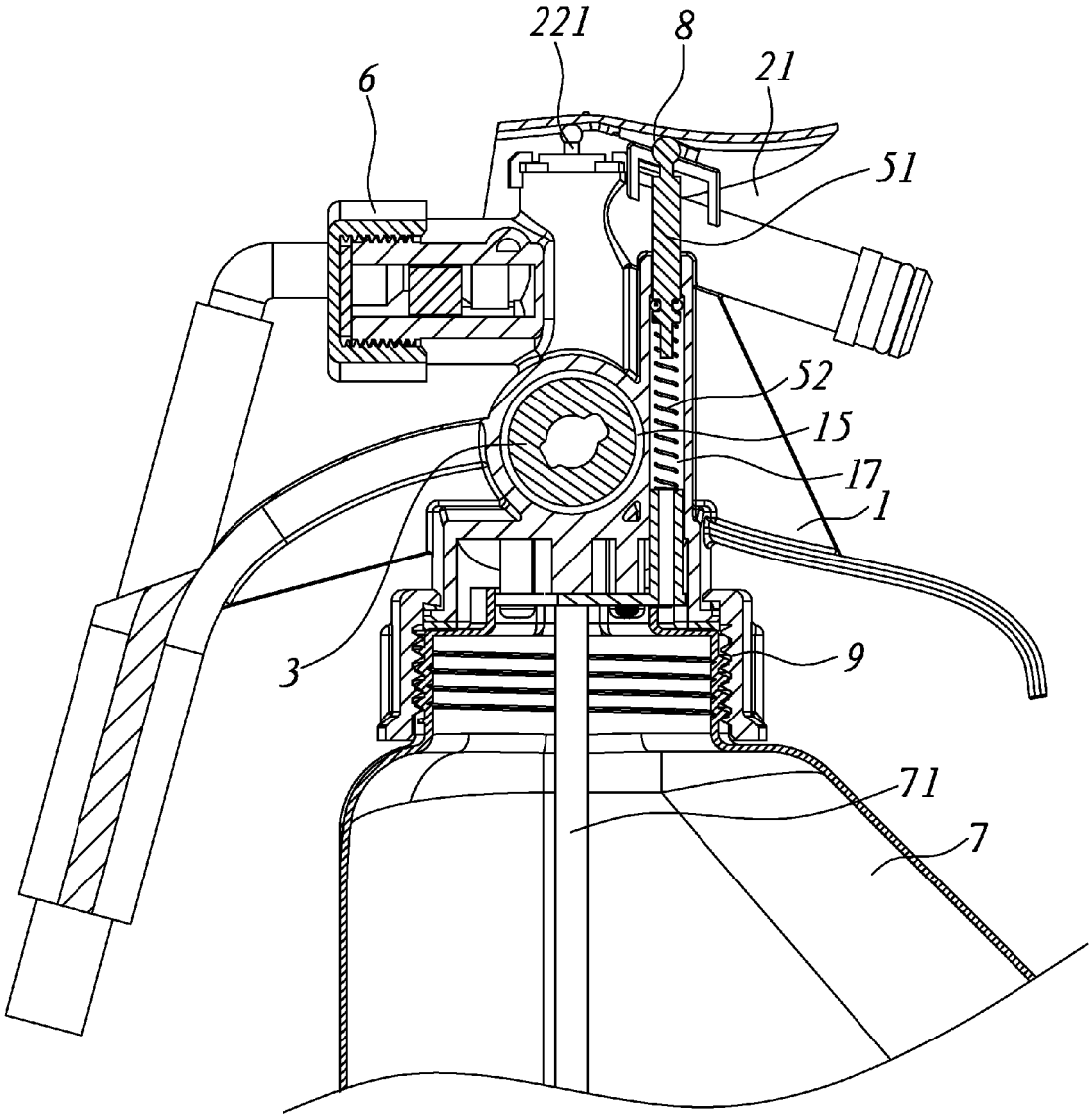
FIG. 9B is a sectional view, showing the position of a ventilation valve (in a small-flow low-concentration status) of the first preferred embodiment of the present invention.

In FIGS. 9A and 9B, when the knob 31 for rotating the regulating device 3 is set to a small-flow low-concentration status, the shallow arc groove 322 of the valve track 32 is disposed on the top of the base chamber 15 and at a position opposite to the valve chamber 11. In the meantime, a shallow slot 332 of the proportional controller track 33 is disposed on the bottom of the base chamber 15 and at a position opposite to the liquid input channel 16, and the top of the proportional regulator 41 abuts the shallow slot 332, and a portion of the liquid outlet hole 412 of the proportional regulator 41 is extended into the base chamber 15, and the liquid supply channel is situated at a semi-opened status. Now, the press handle 21 can be pressed to push the bottom of the bolt shaft 221 to move towards the shallow arc groove 322, so as to open the water supply channel of the dispenser. The restoring spring 223 is situated at a compressed energy storage status, and the press handle 21 synchronously presses the valve stem 51 of the ventilation valve 5 to move downward. The gas inlet channel 17 is situated at an opened status, and the valve stem reset spring 52 is also situated at the compressed energy storage status. Since the moving distance of the bolt shaft 221 is limited by the shallow arc groove 322, the moving distance is smaller, the water input space is smaller, and the water flow is smaller. During the operation of the water supply channel, a negative pressure is formed at the bottom of the valve chamber 11 to drain the concentrated liquid out from the container, and the concentrated liquid passes through a portion of the liquid outlet hole 412 of the proportional regulator 41, and then through the valve chamber 11 along the base chamber 15, and finally flows through the liquid output channel 14 into the spray head 6. The concentrated liquid is mixed with water to form a small-flow low-ratio dilute liquid to be sprayed out from the nozzle 64. In this operation mode, the water input space is smaller, so that the flow is smaller. The proportional regulator 41 for controlling the output of the chemical concentrated liquid is situated at a semi-opened status, so that the quantity of concentrated liquid mixed with water is smaller, and the concentration of the mixed solution is lower, and the ratio of the chemical concentrated liquid to water is smaller. In the small-flow low-concentration operation mode, the locking element 8 can be used for locking press handle 21 to achieve the effect of maintaining the continuous liquid output status of the dispenser similarly. On the other hand, the effect of restoring the original position of the press handle 21 can be achieved.

Figure 10A:
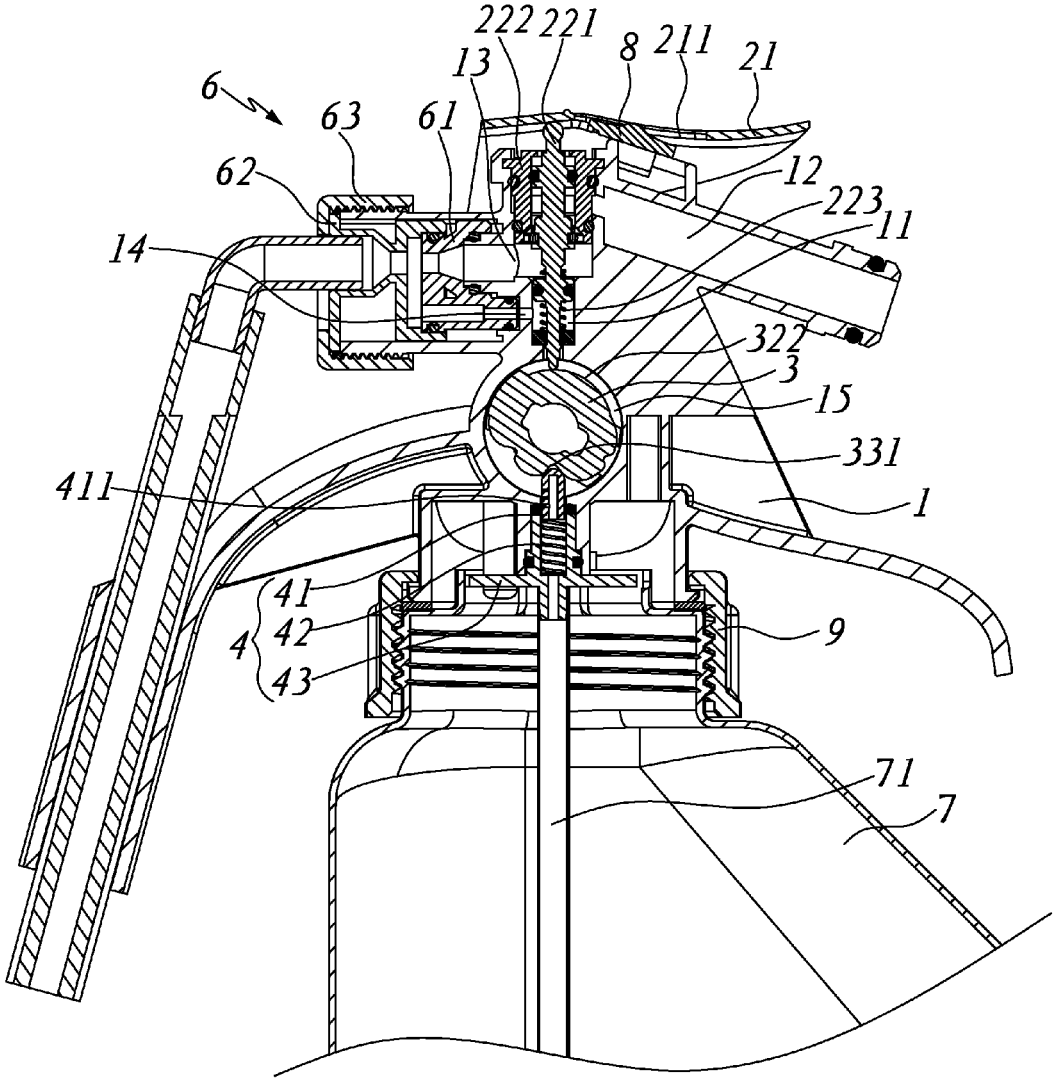
FIG. 10A is a sectional view, showing the position of a valve plug element (in a small-flow high-concentration status) of the first preferred embodiment of the present invention.
Figure 10B:
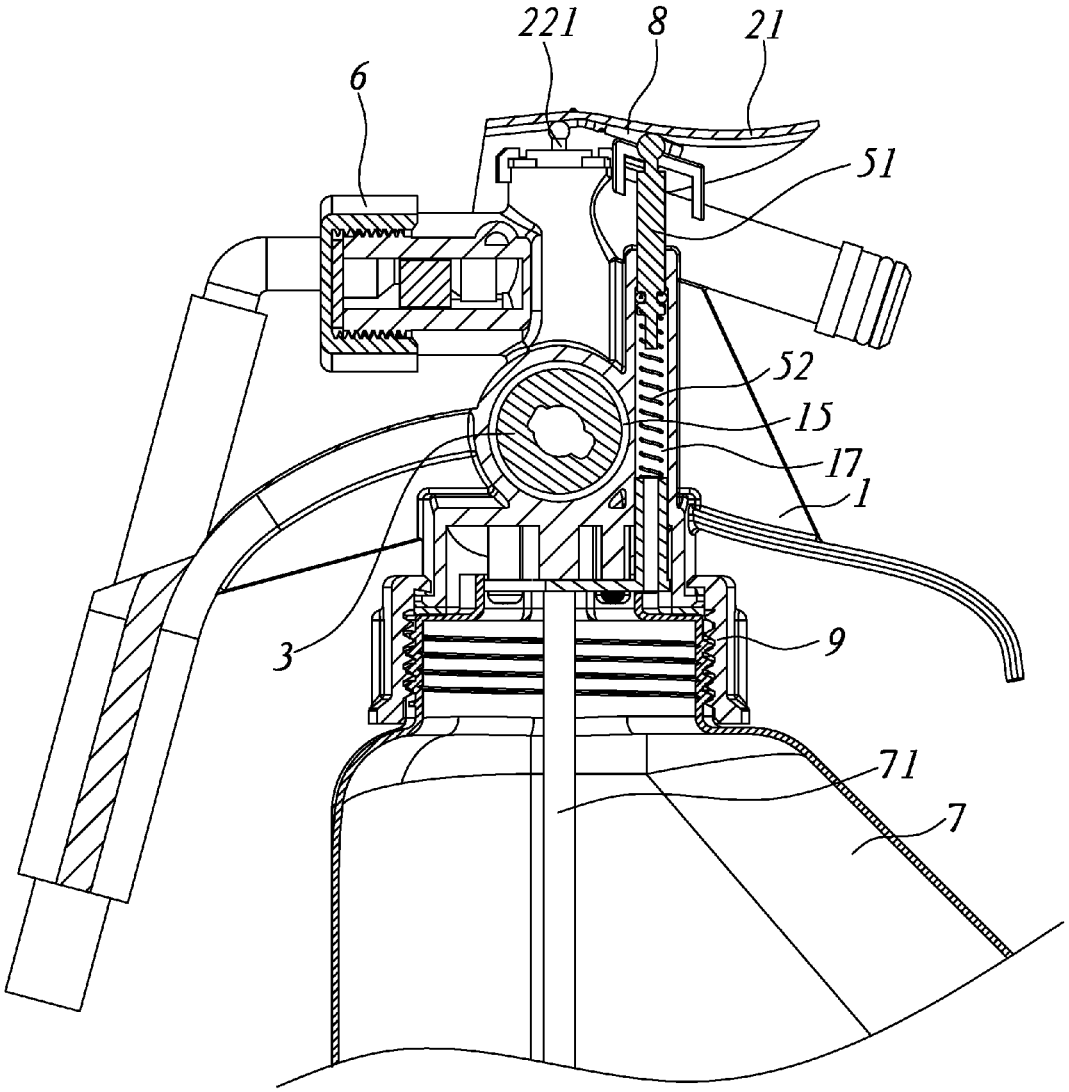
FIG. 10B is a sectional view, showing the position of a ventilation valve (in a small-flow high-concentration status) of the first preferred embodiment of the present invention.

In FIGS. 10A and 10B, when the knob 31 for rotating the regulating device 3 is set to a small-flow high-concentration status, the shallow arc groove 322 of the valve track 32 is also disposed on the top of the base chamber 15 and at a position opposite to the valve chamber 11. In the meantime, a deep slot 333 of the proportional controller track 33 is situated on the bottom of the base chamber 15 and at a position opposite to the liquid input channel 16, and the top of the proportional regulator 41 abuts the deep slot 333, and the whole liquid outlet hole 412 of the proportional regulator 41 is extended into the base chamber 15, and the liquid supply channel is situated at a fully opened status. Now, the press handle 21 can be pressed to push the bottom of the bolt shaft 221 to move towards the shallow arc groove 322, so as to open the water supply channel of the dispenser, and the restoring spring 223 is situated at a compressed energy storage status, and the press handle 21 synchronously presses the valve stem 51 of the ventilation valve 5 to move downward, and the gas inlet channel 17 is situated at an opened status, and the valve stem reset spring 52 is also situated at the compressed energy storage status. Since the moving distance of the bolt shaft 221 is limited by the shallow arc groove 322, the moving distance is smaller, the water input space is smaller, and the water flow is smaller. During the operation of the water supply channel, a negative pressure is formed at the bottom of the valve chamber 11 to drain the concentrated liquid out from the container, and the concentrated liquid passes through the whole liquid outlet hole 412 of the proportional regulator 41, and then flows along the base chamber 15 and from the valve chamber 11 into the spray head 6 through the liquid output channel 14, and finally the concentrated liquid is mixed with water to form a small-flow high-ratio dilute liquid to be sprayed out from the nozzle 64. In this operation mode, the water input space is smaller, so that the flow is smaller, and the proportional regulator 41 for outputting the chemical concentrated liquid is situated at a fully opened status, and the quantity of concentrated liquid mixed with water is greater, and the concentration of the mixed solution is higher. In other words, the ratio of the chemical concentrated liquid to water is greater, and the dispenser is situated at a small-flow high-concentration operation mode. Similarly, the locking element 8 can lock the press handle 21 to achieve the effect of maintaining a continuous liquid output status of the dispenser. On the other hand, the effect of restoring the original position of the press handle 21 can be achieved.

Figure 11A:
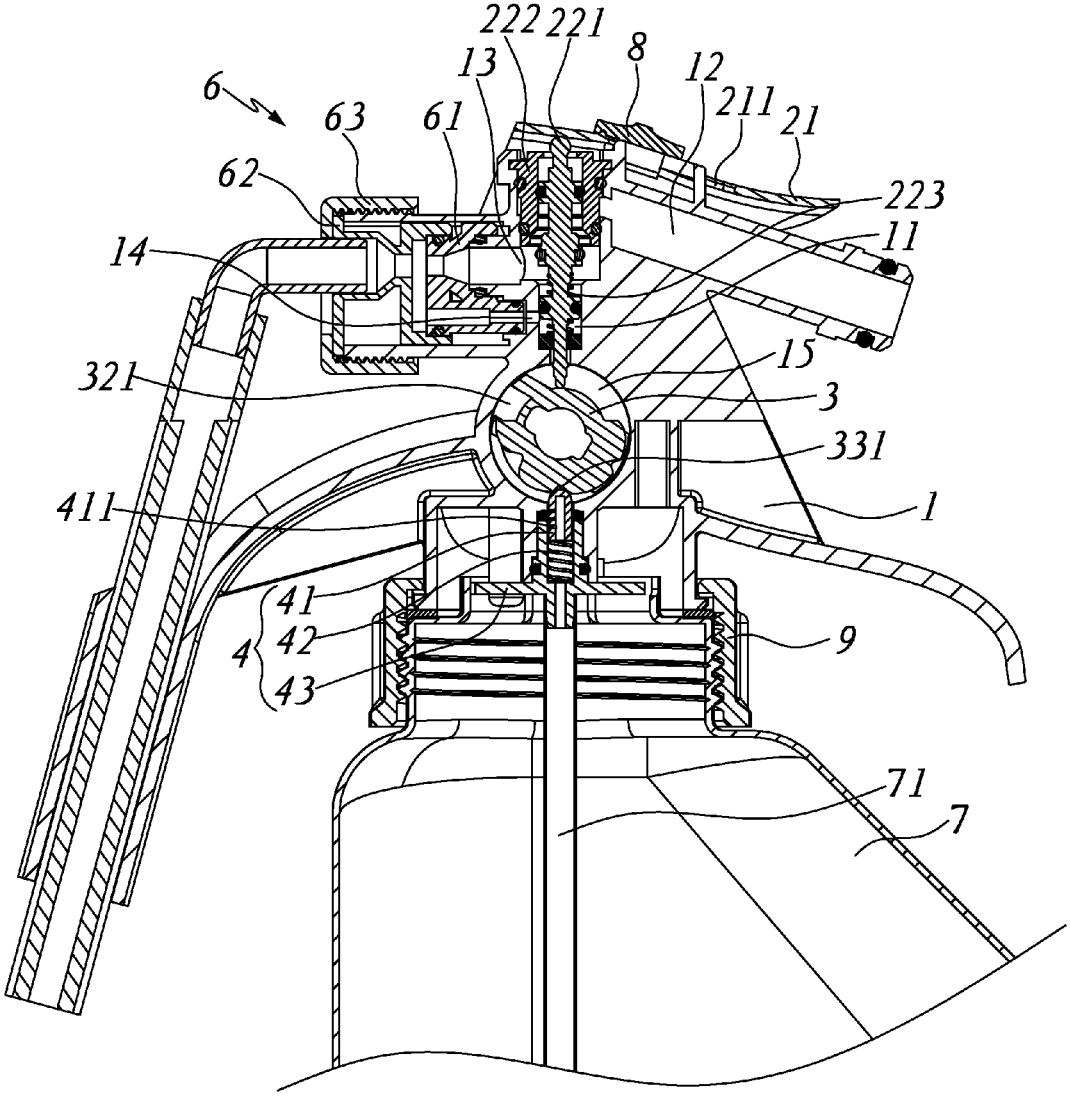
FIG. 11A is a sectional view, showing the position of a valve plug element (in a large-flow low-concentration status) of the first preferred embodiment of the present invention.
Figure 11B:
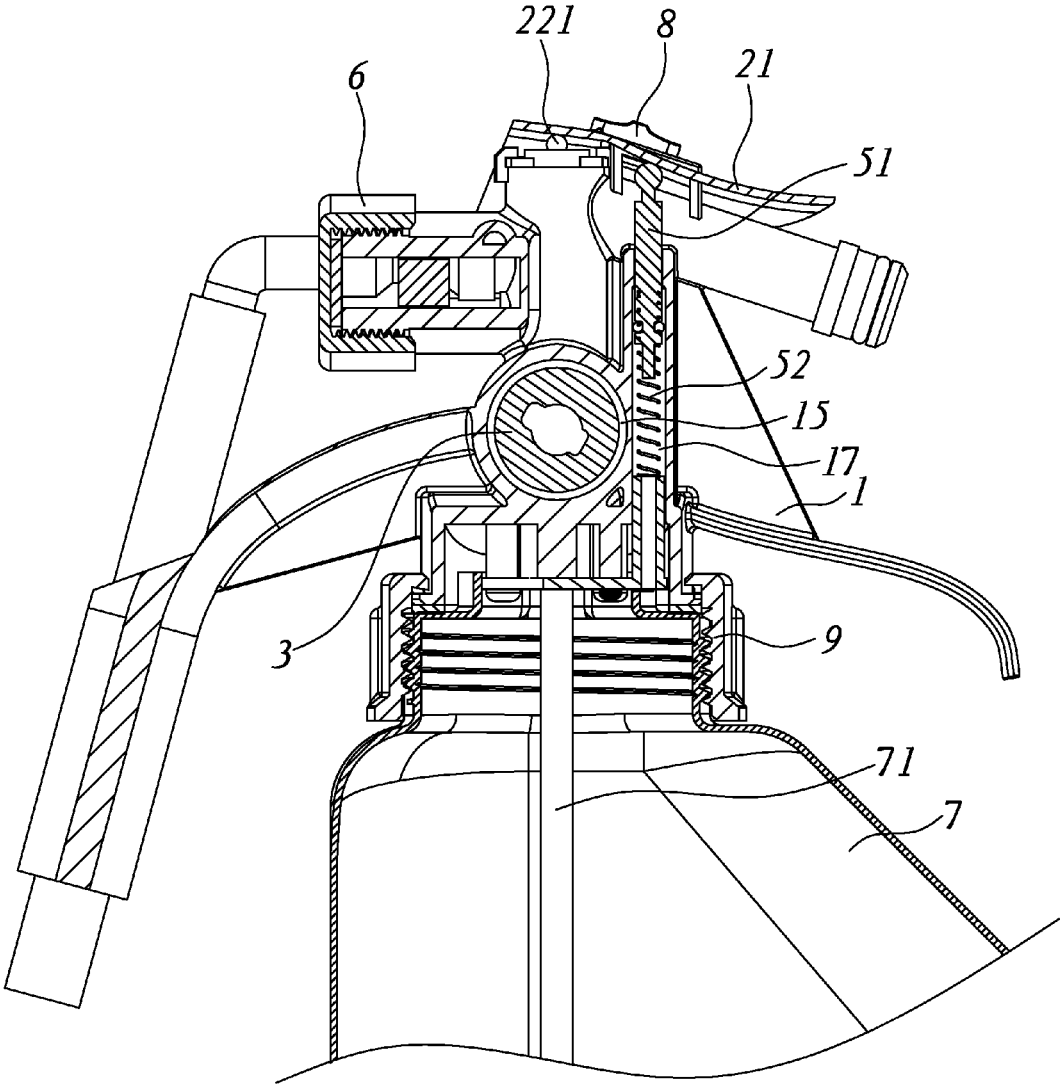
FIG. 11B is a sectional view, showing the position of a ventilation valve (in a large-flow low-concentration status) of the first preferred embodiment of the present invention.

In FIGS. 11A and 11B, when the knob 31 for rotating the regulating device 3 is set to a large-flow low-concentration status, the deep arc groove 323 of the valve track 32 is disposed on the top of the base chamber 15 and at a position opposite to the valve chamber 11. In the meantime, another shallow slot 332 of the proportional controller track 33 is situated on the bottom of the base chamber 15 and at a position opposite to the liquid input channel 16, and the top of the proportional regulator 41 abuts the shallow slot 332, and a portion of the liquid outlet hole 412 of the proportional regulator 41 is extended into the base chamber 15, and the liquid supply channel is situated at a semi-opened status. Now, the press handle 21 can be pressed to push the bottom of the bolt shaft 221 to move towards the deep arc groove 323, so as to open the water supply channel of the dispenser, and the restoring spring 223 is situated at a compressed energy storage status, and the press handle 21 synchronously presses the valve stem 51 of the ventilation valve 5 to move downward, and the gas inlet channel 17 is situated at an opened status, and the valve stem reset spring 52 is also situated at a compressed energy storage status. Since the moving distance of the bolt shaft 221 is limited by the deep arc groove 322, the moving distance is greater, the water input space is fully opened, and the water flow is greater. During the operation of the water supply channel, a negative pressure is formed at the bottom of the valve chamber 11 to drain the concentrated liquid out from the container, and the concentrated liquid passes through a portion of the liquid outlet hole 412 of the proportional regulator 41 and along the base chamber 15 and then flows from the liquid output channel 14 into the spray head 6 through the valve chamber 11, and finally the concentrated liquid is mixed with water to form a large-flow low-ration dilute liquid to be sprayed from the nozzle 64. In this operation mode, the water input space is fully opened, so that the flow is large, and the proportional regulator 41 for outputting the chemical concentrated liquid is situated at a semi-opened status, so that the quantity of the concentrated liquid mixed with water is smaller, and the concentration of the mixed solution is smaller. In other words, the ratio of the chemical concentrated liquid to water is smaller, and the dispenser is situated at a large-flow low-concentration operation mode. Similarly, the locking element 8 can lock the press handle 21 to achieve the effect of maintaining a continuous liquid output status of the dispenser. On the other hand, the effect of restoring the original position of the press handle 21 can be achieved.

Figure 12A:
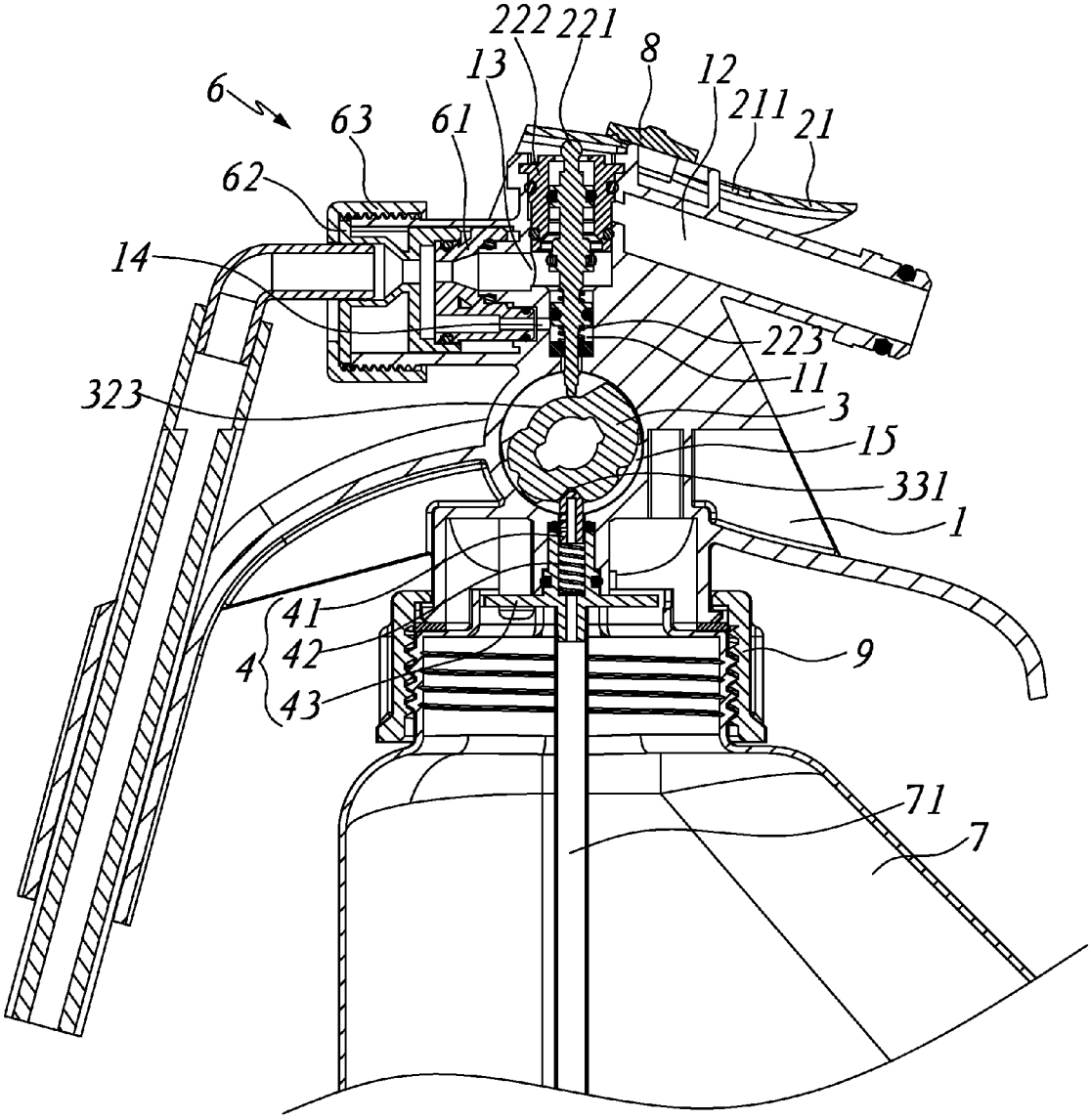
FIG. 12A is a sectional view, showing the position of a valve plug element (in a large-flow high-concentration status) of the first preferred embodiment of the present invention.
Figure 12B:
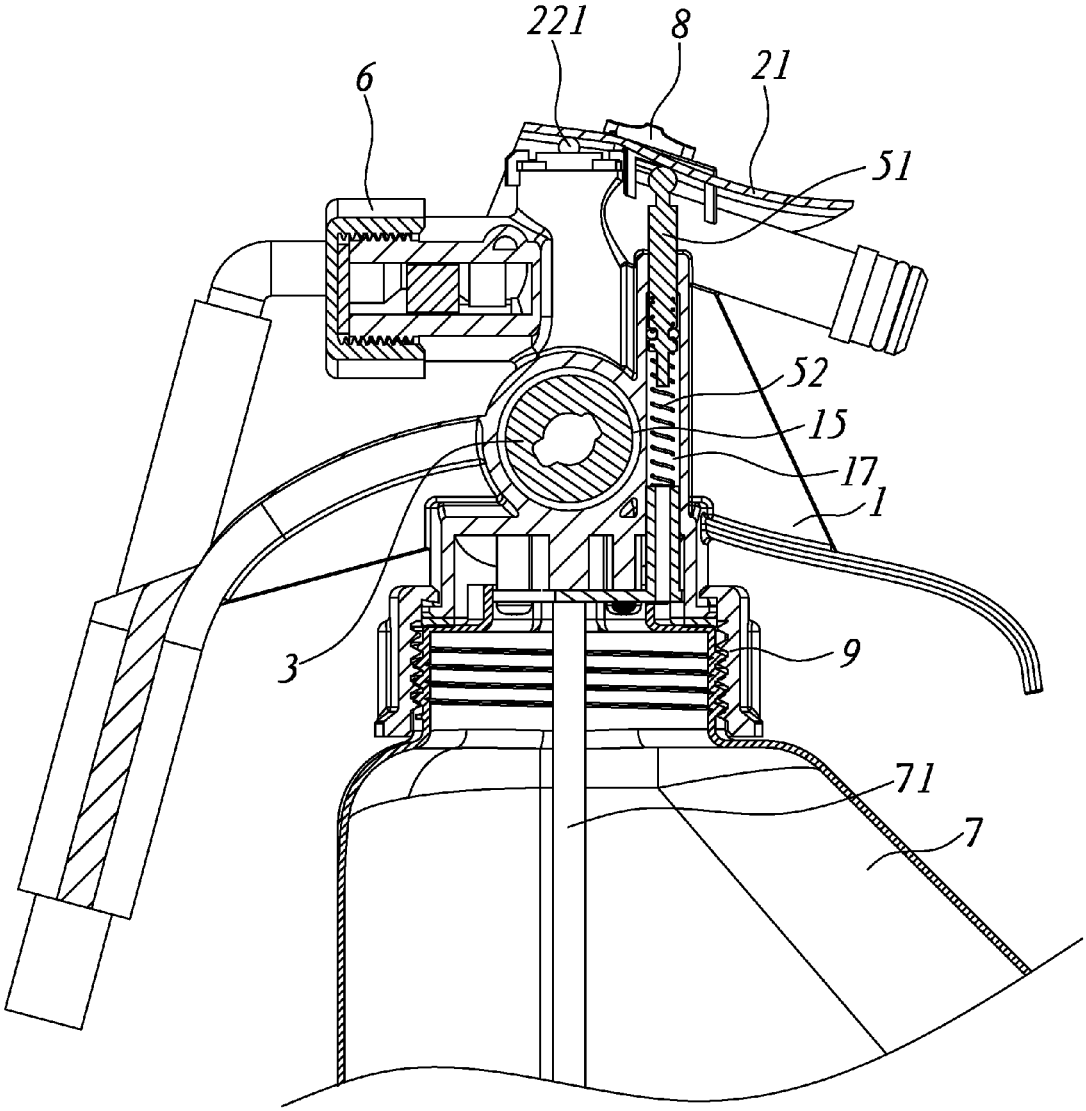
FIG. 12B is a sectional view, showing the position of a ventilation valve (in a large-flow high-concentration status) of the first preferred embodiment of the present invention.
Figure 13:
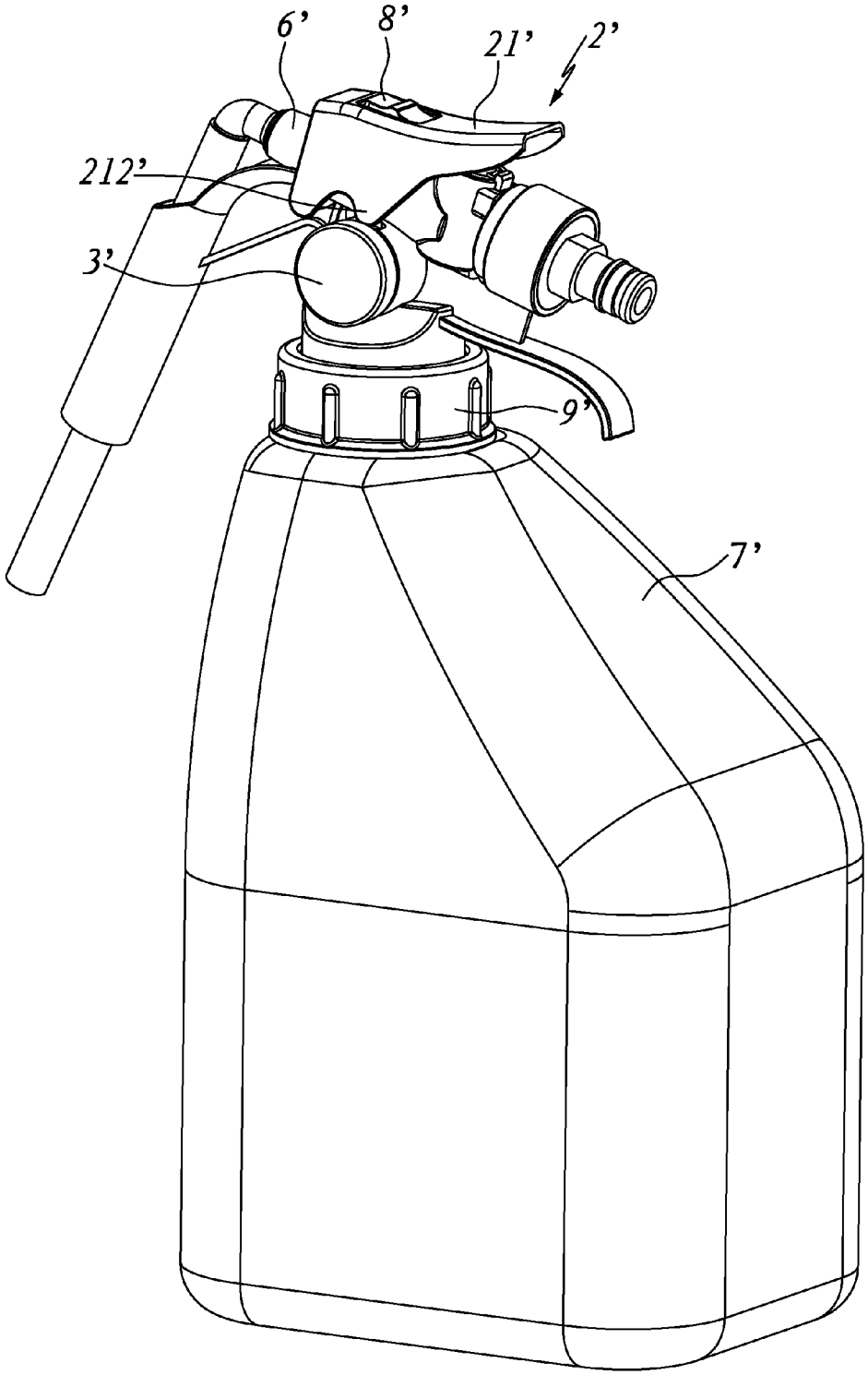
FIG. 13 is a perspective view of a second preferred embodiment of the present invention.
Figure 14:
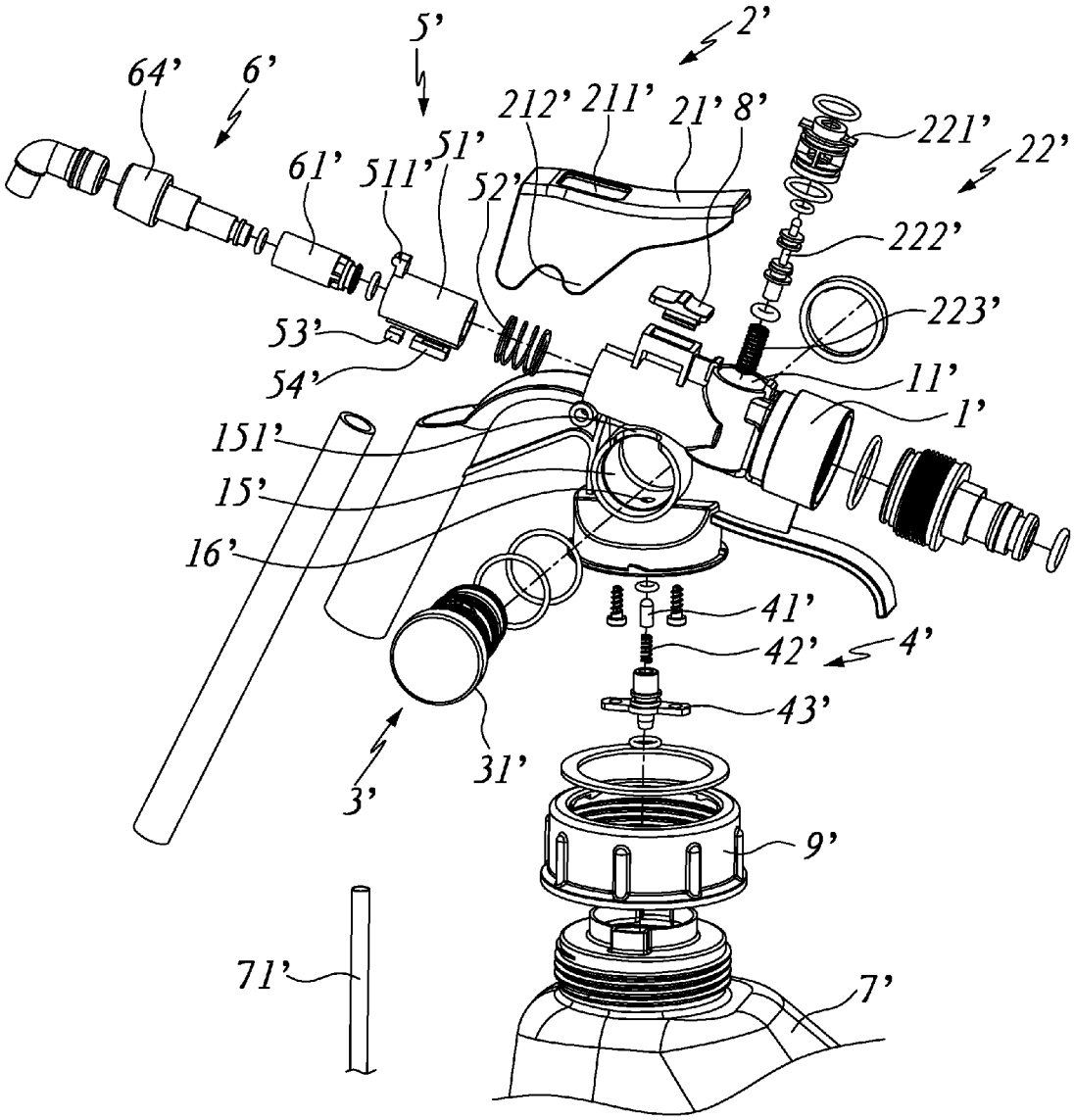
FIG. 14 is an exploded view of the second preferred embodiment of the present invention.

In FIGS. 12A and 12B, set to a large-flow high-concentration status, the deep arc groove 323 of the valve track 32 is also disposed on the top of the base chamber 15 and at a position opposite to the valve chamber 11. In the meantime, another deep slot 333 of the proportional controller track 33 is disposed on the bottom of the base chamber 15 and at a position opposite to the liquid input channel 16, and the top of the proportional regulator 41 abuts the deep slot 332, and the whole liquid outlet hole 412 of the proportional regulator 41 is extended into the base chamber 15, and the liquid supply channel is situated at a fully opened status. Now, the press handle 21 can be pressed to push the bottom of the bolt shaft 221 to move towards the deep arc groove 323, so as to open the water supply channel of the dispenser, and the restoring spring 223 is situated at a compressed energy storage status, and the press handle 21 synchronously presses the valve stem 51 of the ventilation valve 5 to move downward, and the gas inlet channel 17 is situated at an opened status, and the valve stem reset spring 52 is also situated at a compressed energy storage status. Since the moving distance of the bolt shaft 221 is limited by the deep arc groove 322, the moving distance is greater, the water input space is fully opened, and the water flow is greater. During the operation of the water supply channel, a negative pressure is formed at the bottom of the valve chamber 11 to drain the concentrated liquid out from the container, and the concentrated liquid passes through the whole of the liquid outlet hole 412 of the proportional regulator 41 and along the base chamber 15, and flows from the liquid output channel 14 into the spray head 6 through the valve chamber 11, and finally the concentrated liquid is mixed with water to form a large-flow high-ratio dilute liquid to be sprayed from the nozzle 64. In this operation mode, the water input space is fully opened, so that the flow is great, and the proportional regulator 41 for outputting the chemical concentrated liquid is situated in a fully opened status, so that the quantity of the concentrated liquid mixed with water is greater, and the concentration of the mixed solution is higher. In other words, the ratio of the chemical concentrated liquid to water is greater, and the dispenser is situated at a large-flow high-concentration operation mode. Similarly, the locking element 8 can lock the press handle 21 to achieve the effect of maintaining a continuous liquid output status of the dispenser. On the other hand, the effect of restoring the original position of the press handle 21 can be achieved.

Second Preferred Embodiment

With reference to FIGS. 13 to 24B for a multifunctional dispenser in accordance with the second preferred embodiment of the present invention, the multifunctional dispenser comprises a main body 1' having a control valve 2', a regulating device 3', a proportional control device 4' and a ventilation valve 5' installed on main body 1'; a connecting nozzle 6' installed at the front of the main body 1'; a water supply pipe coupled to the rear of the main body 1'; and a concentrated liquid container 7' coupled to the bottom of the main body 1'.

Figure 18A:
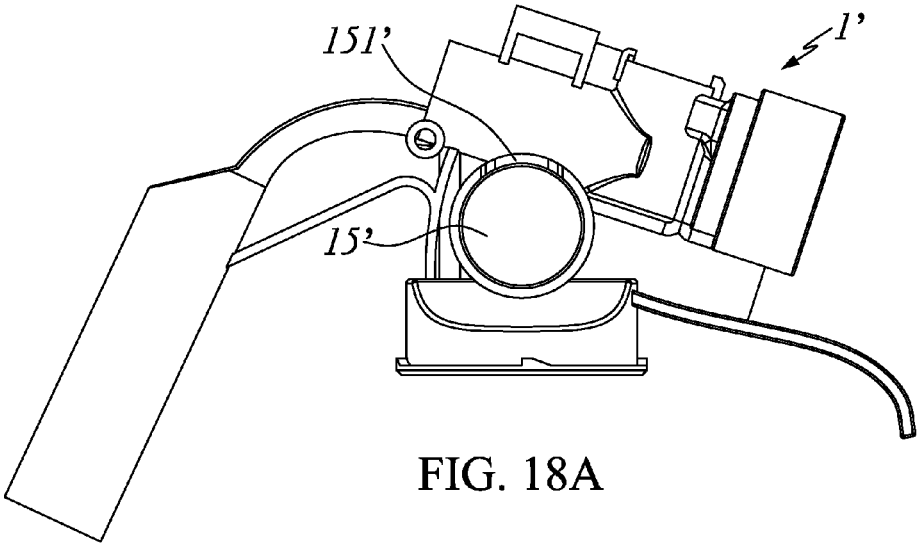
FIG. 18A is a main view of a main body of a dispenser of the second preferred embodiment of the present invention.
Figure 18B:
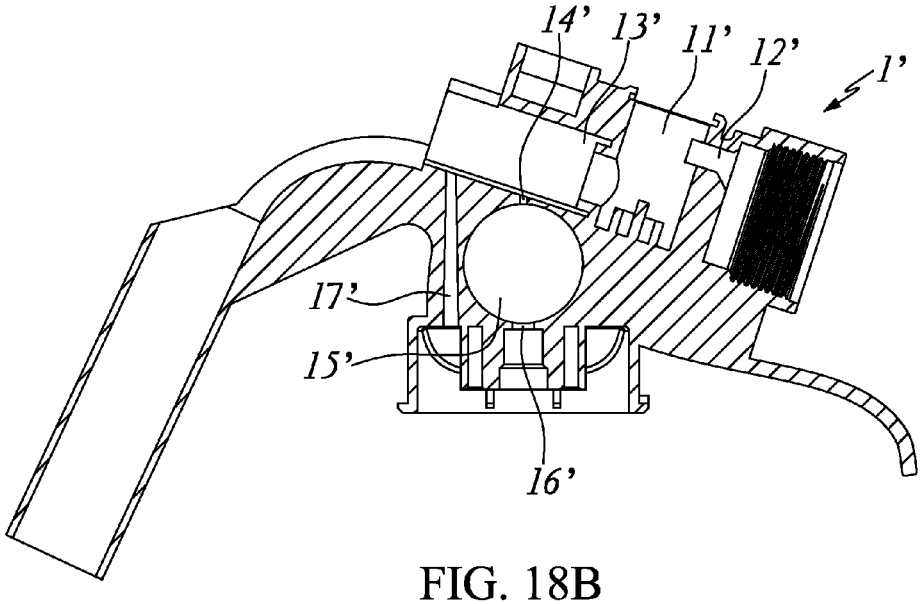
FIG. 18B is a longitudinal sectional view of a main body of a dispenser of the second preferred embodiment of the present invention.
Figure 18C:
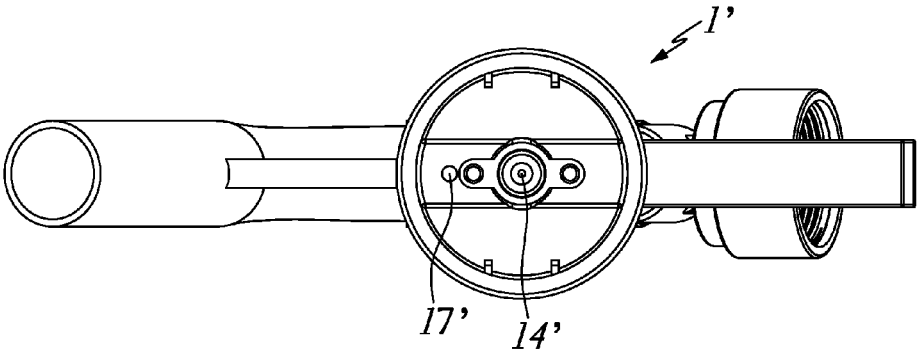
FIG. 18C is a bottom view of a main body of a dispenser of the second preferred embodiment of the present invention.

In FIG. 18A to FIG. 18C, the main body 1' includes a valve chamber 11' formed downwardly from the top of the main body 1' and corresponding to the control valve 2', and both sides of the valve chamber 11' are communicated and coupled to a water inlet channel 12' of the water supply pipe 7' and a water outlet channel 13' of the connecting nozzle 6' respectively, and a base chamber 15' is formed in a transverse direction on the main body 1' at the bottom of the water outlet channel 13' and corresponding to the regulating device 3', and a liquid output channel 14' is formed at the top of the base chamber 15' and communicated with the water outlet channel 13', and a liquid input channel 16' is formed on a sidewall of the bottom of the base chamber 15' and communicated with the container 7' at the bottom of the main body 1', and a notch 151' is formed at the top of an external side of the base chamber 15'. In addition, the main body 1' includes a gas inlet channel 17' passing through the main body 1' is formed in a longitudinal direction with respect to the front of the base chamber 15' and corresponding to the ventilation valve 5'.

The control valve 2' includes a press handle 21' pivotally coupled to the top of the main body 1', a valve bolt module 22' installed in the valve chamber 11' and including a bolt shaft 221', a bolt seat 222' for positioning bolt shaft 221', and a restoring spring 223'. After the valve plug element 22' is assembled into the valve chamber 11' of the main body 1', the bolt shaft 221' is acted by the restoring spring 223' to abut against a lower surface of the press handle 21', and the press handle 21' applies a downward force to push the bolt shaft 221' to move downwardly in the valve chamber 11', so as to open the water supply channel and the liquid supply channel.

The bottom of the front of the press handle 21' is pivotally coupled to the main body 1' at the front of the base chamber 15', and a top pressing surface is formed on the top of the press handle 21', and the top pressing surface has a long corresponding slot 211' provided for installing a locking element 8'. The bottom of the locking element 8' can be movably installed on the main body 1' to define a locking relation with the press handle 21', and both sides of the press handle 21' have a limit lug 22' aligned precisely with the notch 151' at the top of the base chamber 15' of the main body 1'.

Figure 15:
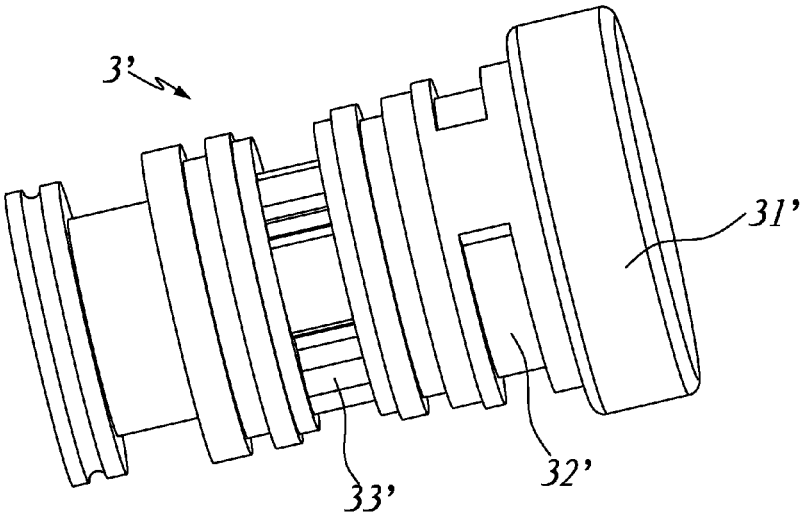
FIG. 15 is a perspective view of a regulating device of the second preferred embodiment of the present invention.
Figure 16A:
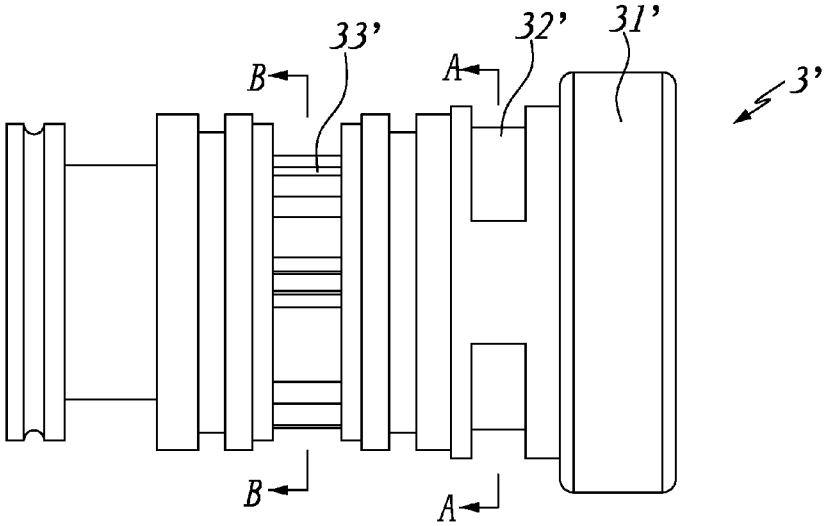
FIG. 16A is a main view of a regulating device of the second preferred embodiment of the present invention.
Figure 16B:
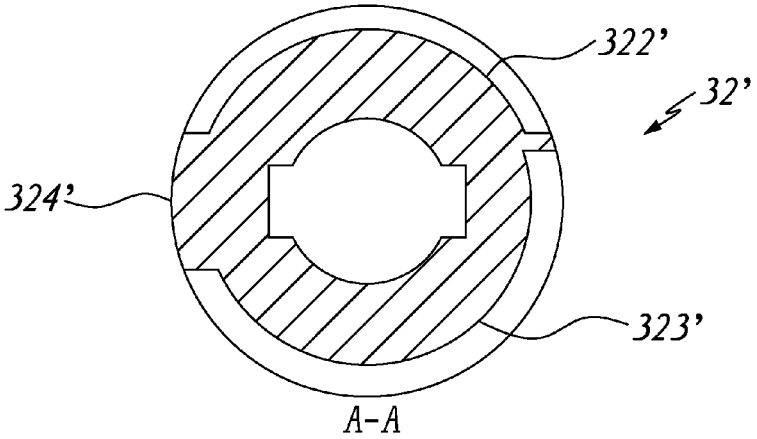
FIG. 16B is a sectional view of Section A-A of FIG. 16.
Figure 16C:
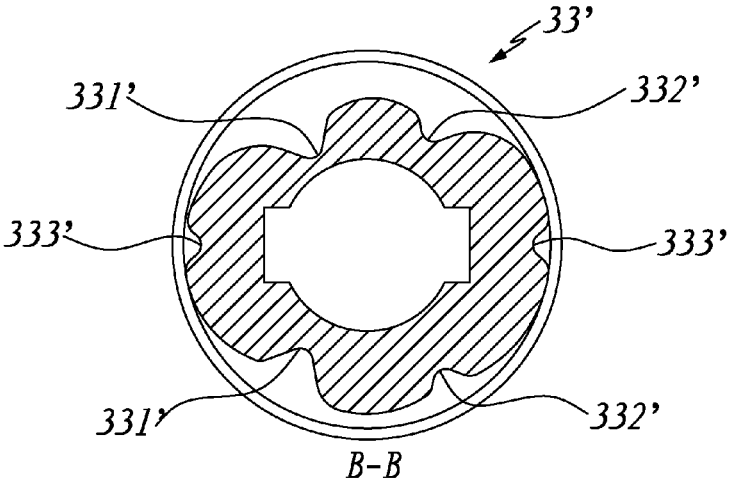
FIG. 16C is a sectional view of Section B-B of FIG. 16.

In FIG. 15 to FIG. 16C, the regulating device 3' is a cylinder sealed into the base chamber 15' of the main body 1', and a knob 31' is formed at the front of the regulating device 3' and extended outside the main body 1', and the cylinder at the rear of the knob 31' is extended into the base chamber 15'. The cylinder has a valve track 32' and a proportional controller track 33' formed at positions corresponding to the control valve 2' and the proportional control device 4' respectively.

In FIG. 16B, the valve track 32' is adjacent to the knob 31', and a shallow arc groove 322', a deep arc groove 323' and an outer arc section 324' with the same diameter of the base chamber 15' are formed at the external periphery of the cylinder, wherein the shallow arc groove 322', the deep arc groove 323' and the outer arc section 324' determines the movable depth and size of the limit lug 22' of the control valve 2' in a longitudinal direction.

In FIG. 16C, the proportional controller track 33' includes a plurality of grooves formed in a radial direction of the cylinder, and two adjacent grooves are connected by an arc to define a wavy shape with different depths at different positions of the whole proportional controller track 33. In this preferred embodiment, there are two deep slots 331', two shallow slots 332' and two positioning slots 333', but the invention is not limited to such arrangements only, and the depth of the groove determines the outputted quantity of concentrated liquid controlled by the proportional control device 4', and the quantity of grooves determines the concentration, and thus the quantity of grooves can be adjusted to change the level of concentration.

Figure 17A:
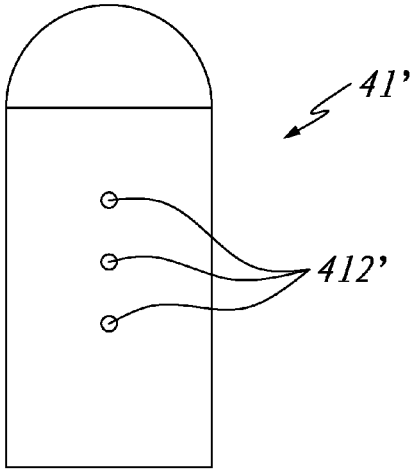
FIG. 17A is a main view of a proportional regulator of the second preferred embodiment of the present invention.
Figure 17B:
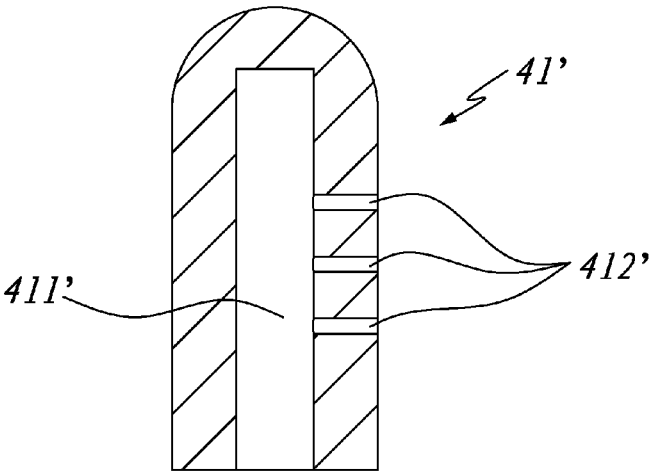
FIG. 17B is a sectional view of a proportional regulator of the second preferred embodiment of the present invention.

With reference to FIGS. 17A and 17B, the proportional control device 4' includes a proportional regulator 41', a restoring spring 42' and a connecting base 43', and the proportional regulator 41' and the restoring spring 42' are installed in the connecting base 43' and communicated with a draft tube 71' in the container 7', and the proportional regulator 41' pressed by the restoring spring 42' always abuts the proportional controller track 33'. The proportional regulator 41' is a bullet head having a sink hole 411' and includes a plurality of liquid outlet hole 412' formed in a longitudinal direction on a sidewall of the proportional regulator 41' and communicated with the sink hole 411'. In preferred embodiment, there are three liquid outlet holes 412' formed in a longitudinal direction, and the quantity and size of the liquid outlet holes 412' determine the quantity of concentrated liquid outputted from the container 7'.

The ventilation valve 5' includes a sliding sleeve 51' and a sliding sleeve spring 52' installed in the water outlet channel 13', and an air hole gasket 53' and a liquid outlet gasket 54' formed on the sliding sleeve 51', and the sliding sleeve spring 52' and the sliding sleeve 51' having the gaskets 53', 54' are installed sequentially into the water outlet channel 13' of the main body 1' and limited by the spray head 6'. In the meantime, the sliding sleeve 51' and the press handle 21' are integrated with each other. During the operation of the press handle 21', the sliding sleeve 51' moves back and forth in the water outlet channel 13'. When the press handle 21' is normally not operated, the air hole gasket 53' and the liquid outlet gasket 54' precisely seal the top of the gas inlet channel 17' and the liquid output channel 14'. When the press handle 21' is moved downward for operation, the sliding sleeve 51' moves backward. Now, the air hole gasket 53' and the liquid outlet gasket 54' on the sliding sleeve 51' are no longer aligned with the gas inlet channel 17' and the liquid output channel 14', so that both gas inlet channel 17' and liquid output channel 14' are situated at an opened status. In this preferred embodiment, a hook 511' is formed at the top of the front of the sliding sleeve 51' and integrated with the front of the press handle 21'. It is noteworthy that the structure of the hook 511' and the press handle 21' is not limited to the aforementioned structure only, but any structure that allows the press handle 21' to drive the sliding sleeve 51' to move can be adopted in the invention.

The spray head 6' includes a connecting pipe 61' and a nozzle 64', and the connecting pipe 61' is provided for connecting the nozzle 64' with the water outlet channel 13' of the main body 1'.

A mouth 72' of the container 7' is sealed with the bottom of the main body 1' through a locking nut 9', and the proportional control device 4' is installed in the main body 1'.

Figure 19A:
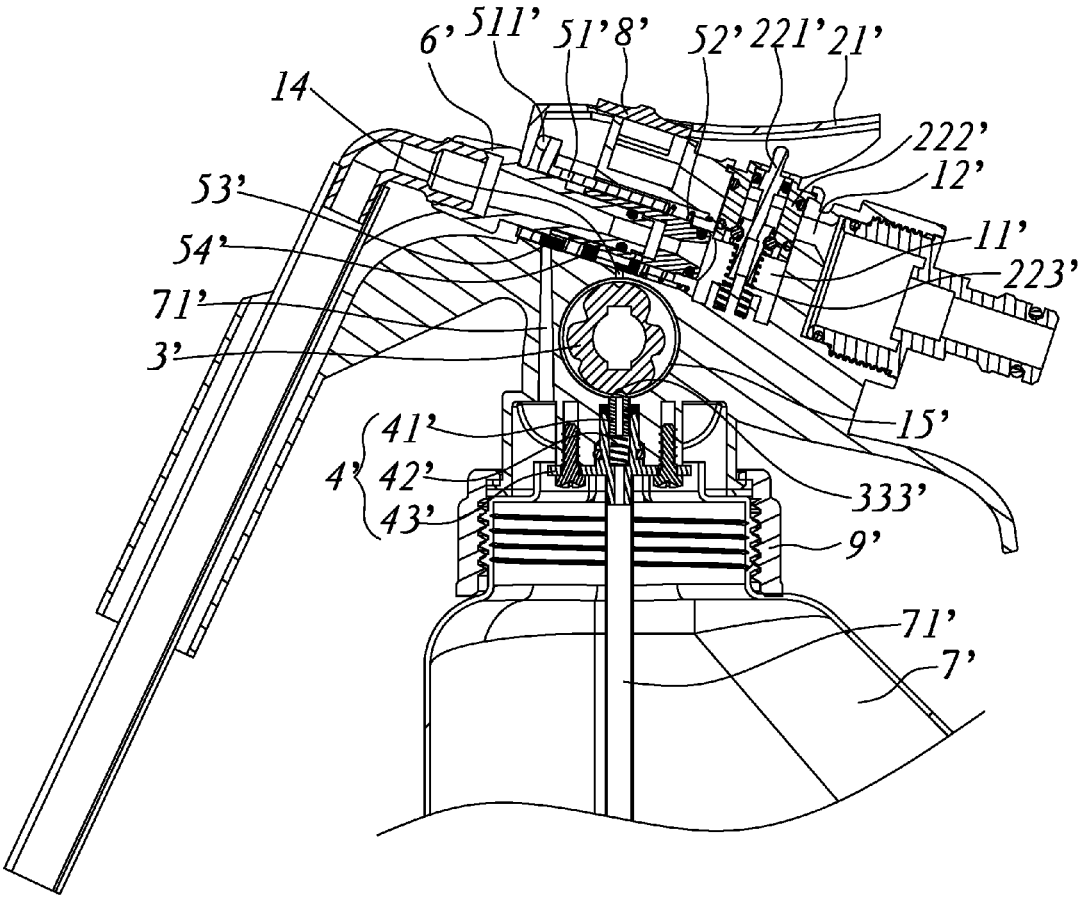
FIG. 19A is a sectional view, showing the position of a valve plug element (in a fully closed status) of the second preferred embodiment of the present invention.
Figure 19B:
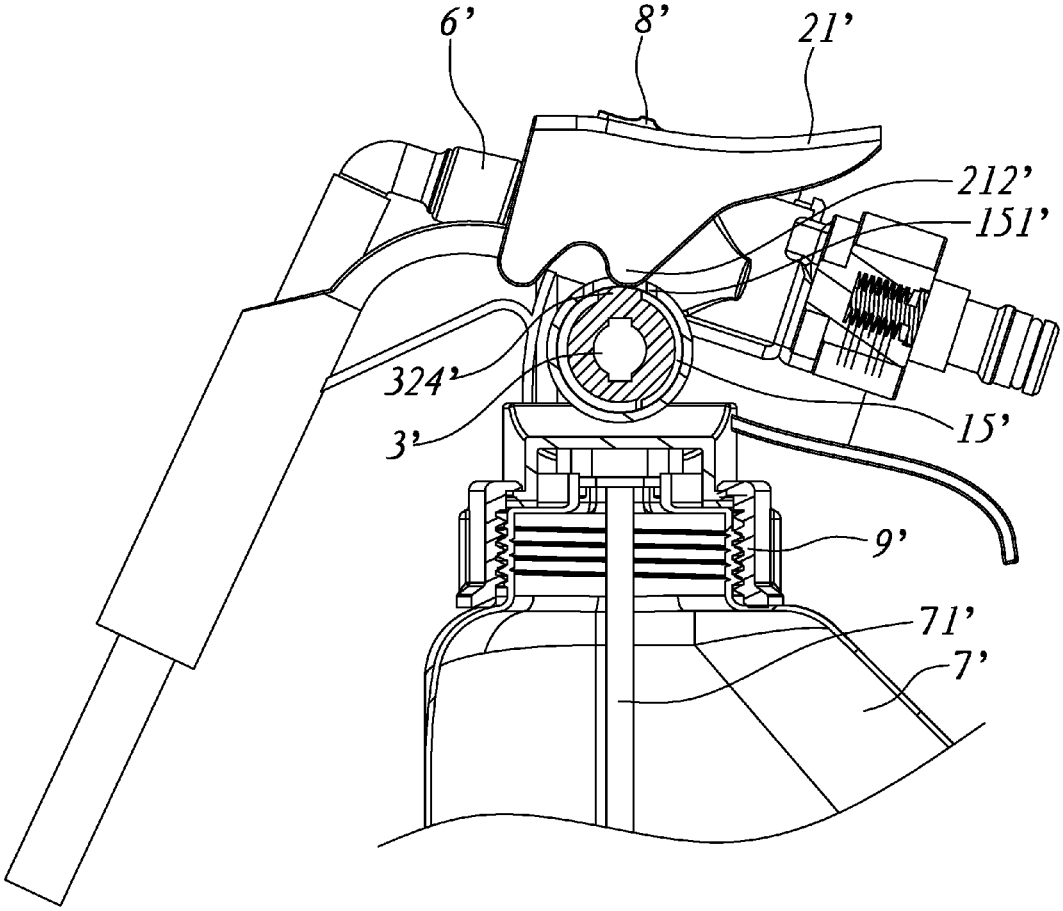
FIG. 19B is a sectional view, showing the position of a valve track (in a fully closed status) of the second preferred embodiment of the present invention.

The specific operation modes of the second preferred embodiment of the present invention are described as follows:

In FIGS. 19A and 19B, when the knob 31' for rotating the regulating device 3' is set to a closed status, the outer arc section 324' of the valve track 32' is disposed on the top of the base chamber 15' and at a position of the notch 151'. In the meantime, the positioning slot 333' of the proportional controller track 33' is disposed on the bottom of the base chamber 15' and at a position opposite to the liquid input channel 16', and the top of the proportional regulator 41' abuts the positioning slot 333', and the liquid outlet hole 412' of the proportional regulator 41' is disposed outside the base chamber 15' and limited by the outer arc section 324'. Now, the limit lug 212' of the press handle 21' has no space for moving downward, so that the press handle 21' cannot be pressed, and both water supply channel and liquid supply channel of the dispenser are situated in a closed status, and no water or mixture can be outputted. In other words, the dispenser is situated at a non-operating mode, and such arrangement can prevent leakage and facilitate the transportation and storage of the dispenser containing the concentrated liquid.

Figure 20A:
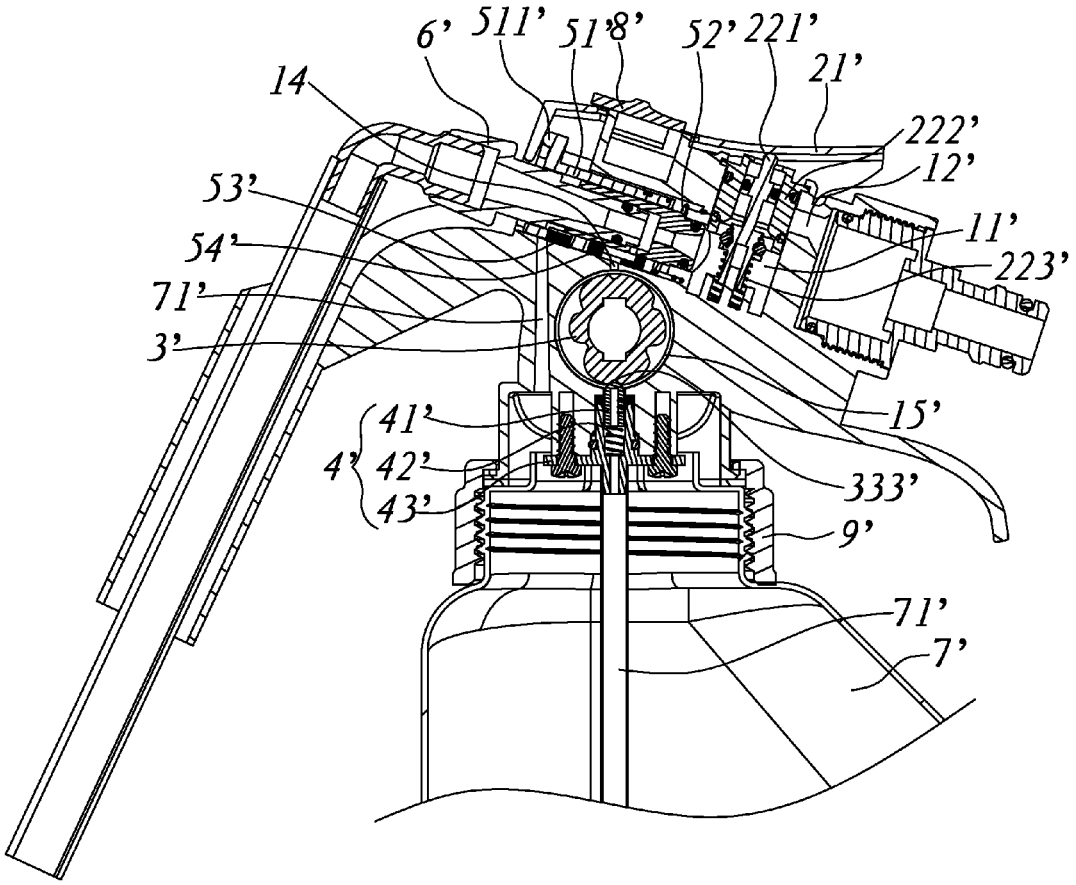
FIG. 20A is a sectional view, showing the position of a valve plug element (in a water output status only) of the second preferred embodiment of the present invention.
Figure 20B:
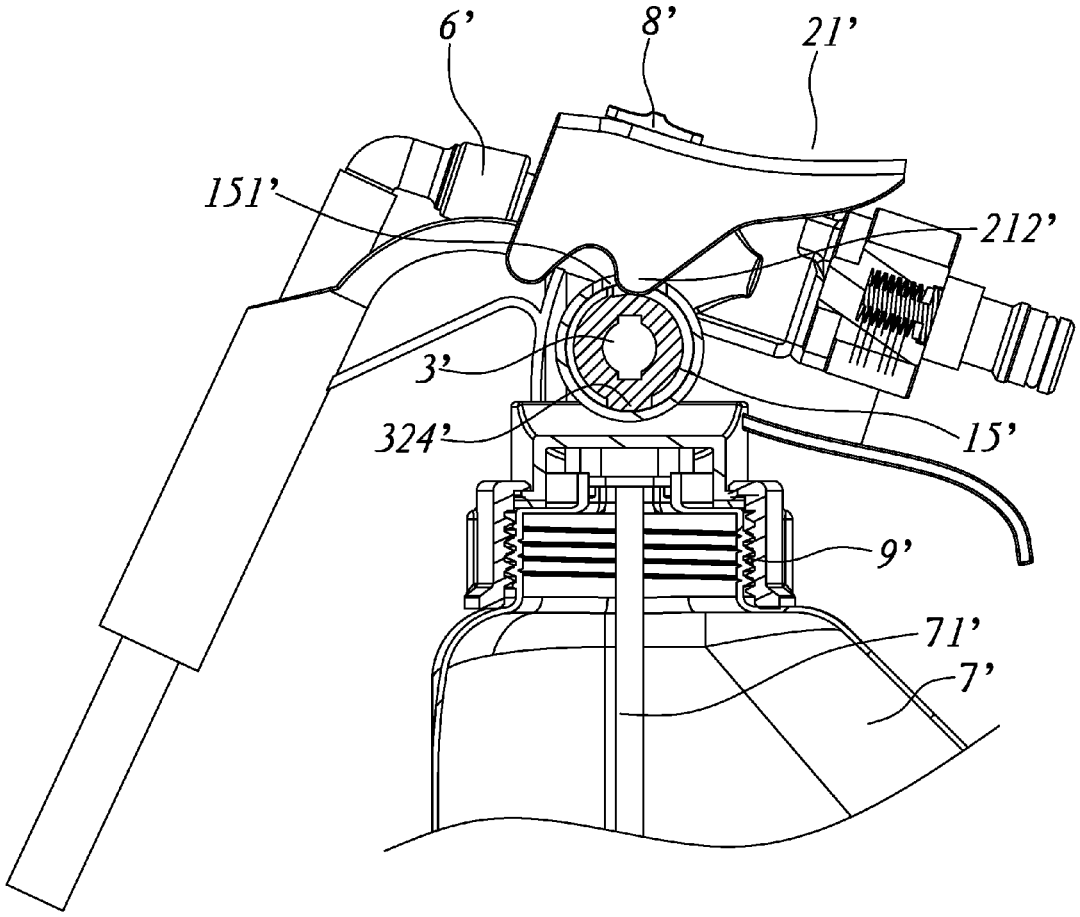
FIG. 20B is a sectional view, showing the position of a valve track (in a water output status only) of the second preferred embodiment of the present invention.

In FIGS. 20A and 20B, when the knob 31' for rotating the regulating device 3' is set to a water output status, the deep arc groove 323' of the valve track 32' is disposed at the position of the notch 151' on the top of the base chamber 15'. In the meantime, another positioning slot 333' of the proportional controller track 33' is disposed on the bottom of the base chamber 15' and at a position opposite to the liquid input channel 16', and the top of the proportional regulator 41' abuts the positioning slot 333', and the liquid outlet hole 412' of the proportional regulator 41' is disposed outside the base chamber 15'. In other words, the concentrated liquid cannot be drained, and the liquid supply channel is situated in a closed status. Now, if the press handle 21' is pressed, the limit lug 212' of the press handle 21' is moved in the deep arc groove 323' and towards the notch 151' while driving the bolt shaft 221' to move downward to open the water supply channel of the dispenser, and the restoring spring 223' is situated in a compressed energy storage status. Now, the nozzle 64' can spray water only. If the press handle 21' is released, the bolt shaft 221' will restore its original position to close the water supply channel. To save power and effort of the operation, the dispenser keeps outputting water. After the press handle 21' is pressed to push the locking element 8' to latch the press handle 21', the press handle 21' is limited and cannot restore its original position, so that the dispenser can continue the water output without the need of applying force to the press handle 21'. On the other hand, the effect of restoring the original position of the press handle 21' can be achieved.

Figure 21A:
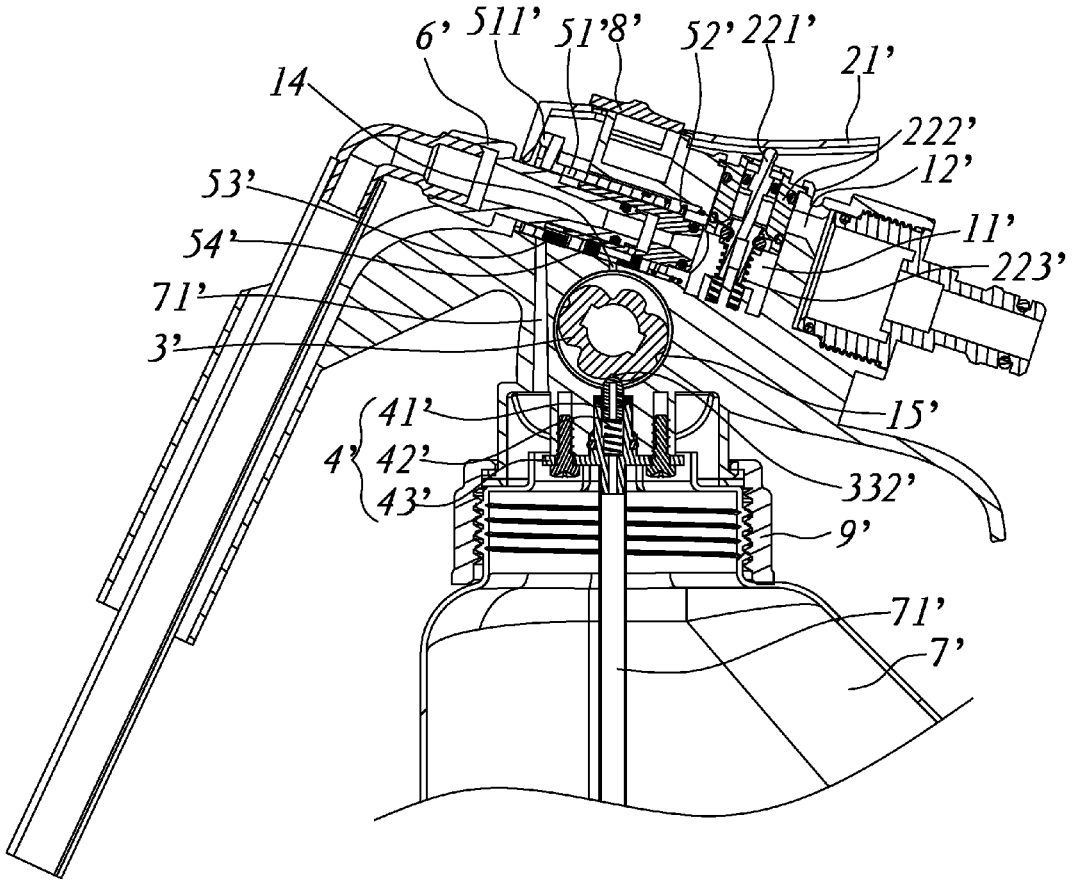
FIG. 21A is a sectional view, showing the position of a valve plug element (in a small-flow low-concentration status) of the second preferred embodiment of the present invention.
Figure 21B:
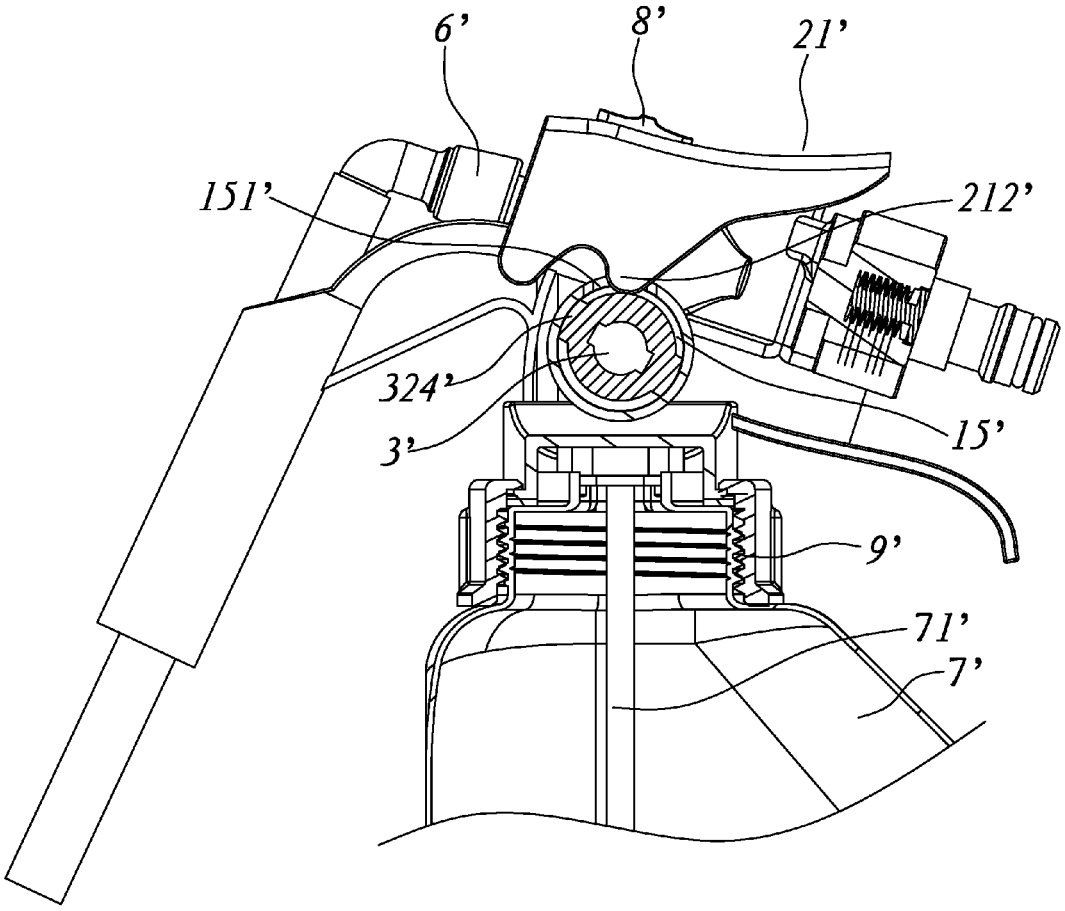
FIG. 21B is a sectional view, showing the position of a valve track (in a small-flow low-concentration status) of the second preferred embodiment of the present invention.

In FIGS. 21A and 21B, when the knob 31' for rotating the regulating device 3' is set to a small-flow low-concentration status, the shallow arc groove 322' of the valve track 32' is disposed at the position of the notch 151' on the top of the base chamber 15'. In the meantime, a shallow slot 332' of the proportional controller track 33' is disposed on the bottom of the base chamber 15' and at a position opposite to the liquid input channel 16', and the top of the proportional regulator 41' abuts the shallow slot 332', and a portion of the liquid outlet hole 412' of the proportional regulator 41' is extended into the base chamber 15', and the liquid supply channel is situated in a semi-opened status. Now, the press handle 21' can be pressed to push the bolt shaft 221' to move downward, so as to open the water supply channel of the dispenser, and the restoring spring 223' is situated in a compressed energy storage status. The press handle 21' synchronously drives the sliding sleeve 51' to move backward, and the air hole gasket 53' and the liquid outlet gasket 54' are no longer aligned precisely with the gas inlet channel 17' and the liquid output channel 14' on the sliding sleeve 51', so that both gas inlet channel 17' and liquid output channel 14' are situated in an opened status, and the sliding sleeve reset spring 52' is also situated in the compressed energy storage status. Since the moving distance of the limit lug 212' of the press handle 21' is limited by the shallow arc groove 322', the moving distance is smaller, the water input space is smaller, and the water flow is smaller. During the operation of the water supply channel, a negative pressure is formed in the water outlet channel 13' to drain the concentrated liquid out from the container 7', and the concentrated liquid passes through a portion of the liquid outlet hole 412' of the proportional regulator 41' and along the base chamber 15' and then flows into the water outlet channel 13' through the liquid output channel 14', and finally the concentrated liquid is mixed with water to form a small-flow low-ratio dilute liquid to be sprayed out from the nozzle 64'. In this operation mode, the water input space is smaller, and the flow is smaller, and the proportional regulator 41' of the chemical concentrated liquid is situated in a semi-opened status, so that the quantity of concentrated liquid mixed with water is smaller, and the concentration of the mixed solution is lower. In other words, the ratio of the chemical concentrated liquid to water is smaller, and the dispenser is situated in a small-flow low-concentration operation mode. Similarly, the locking element 8' can be used for locking press handle 21' to achieve the effect of maintaining the continuous liquid output status of the dispenser similarly. On the other hand, the effect of restoring the original position of the press handle 21' can be achieved.

Figure 22A:
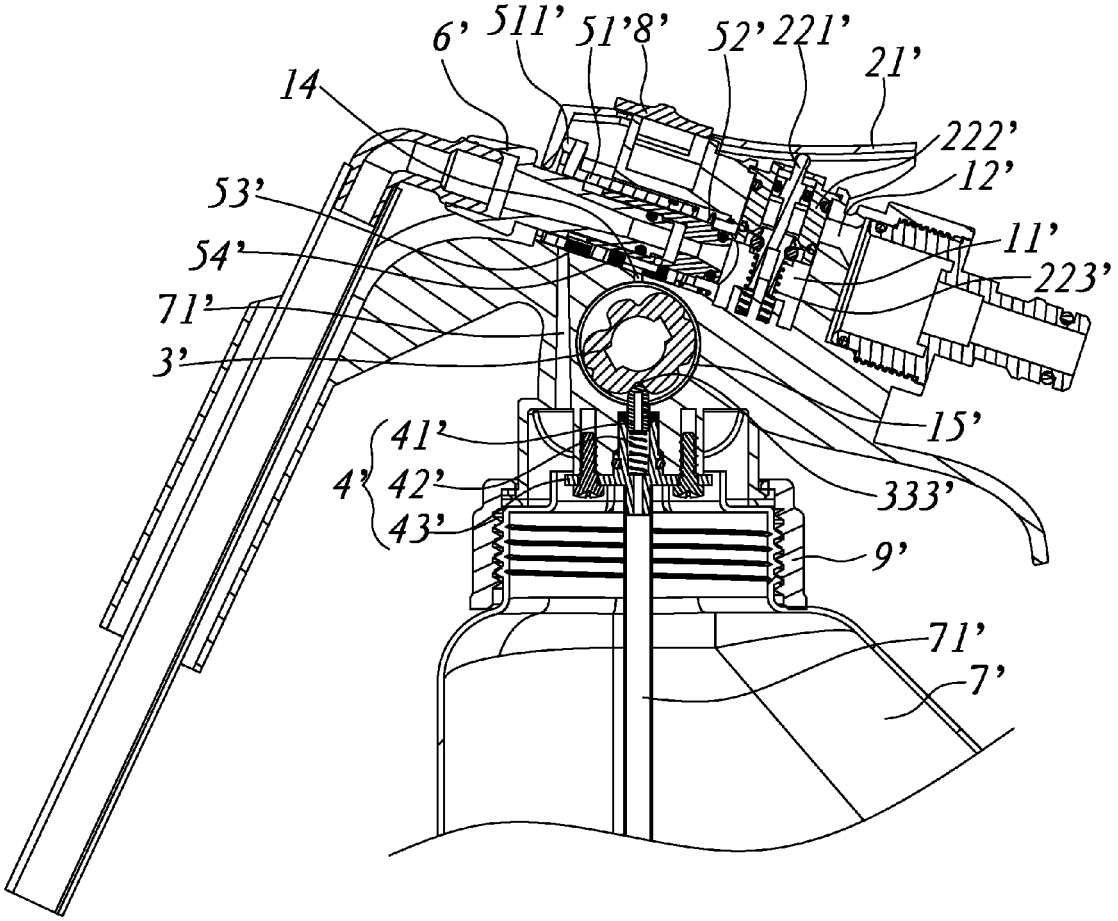
FIG. 22A is a sectional view, showing the position of a valve plug element (in a small-flow high-concentration status) of the second preferred embodiment of the present invention.
Figure 22B:
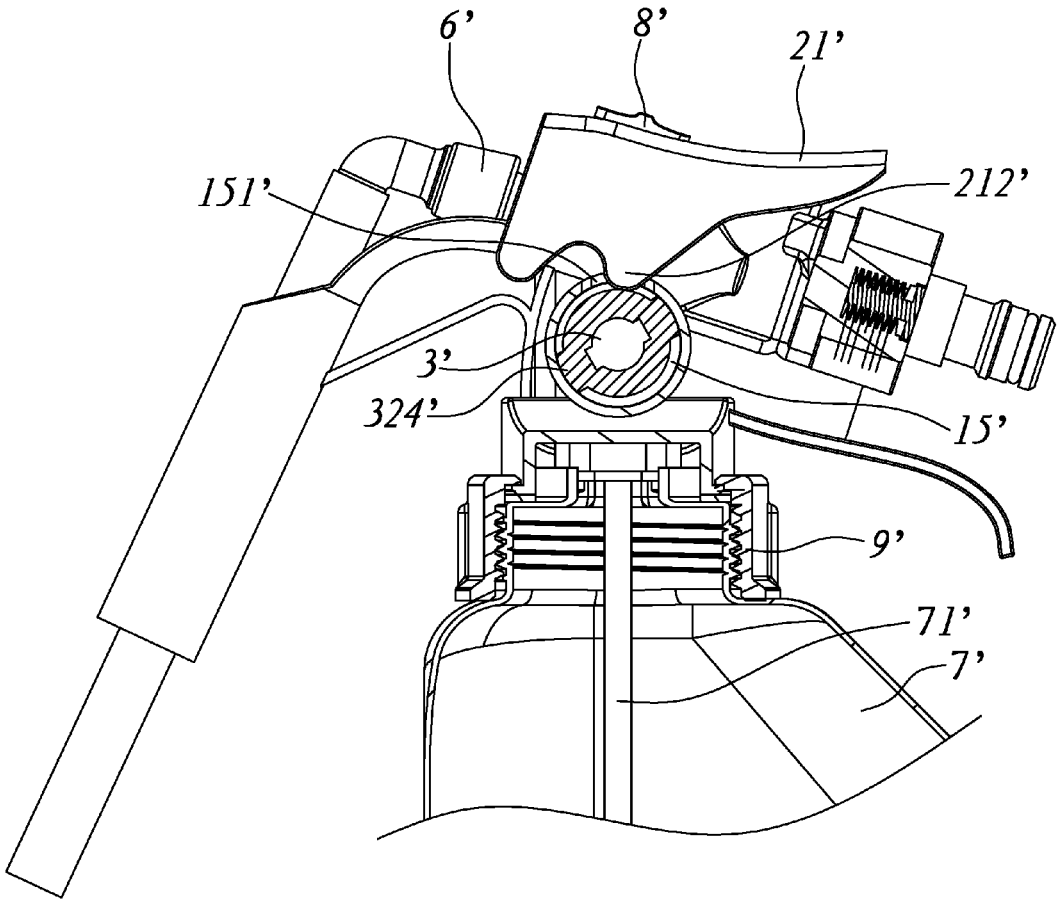
FIG. 22B is a sectional view, showing the position of a valve track (in a small-flow high-concentration status) of the second preferred embodiment of the present invention.

In FIGS. 22A and 22B, when the knob 31' for rotating the regulating device 3' is set to a small-flow high-concentration status, the shallow arc groove 322' of the valve track 32' is disposed at the position of a notch 151' formed on the top of the base chamber 15'. In the meantime, a deep slot 333' of the proportional controller track 33' is disposed on the bottom of the base chamber 15' and at a position opposite to the liquid input channel 16', and the top of the proportional regulator 41' abuts the deep slot 333', and the whole of the liquid outlet hole 412' of the proportional regulator 41' is extended into the base chamber 15', and the liquid supply channel is situated at a fully opened status. Now, the press handle 21' can be pressed to push the bolt shaft 221' to move downward, so as to open the water supply channel of the dispenser, and the restoring spring 223' is situated in a compressed energy storage status. The press handle 21' synchronously drives the sliding sleeve 51' to move backward, and the air hole gasket 53' and the liquid outlet gasket 54' on the sliding sleeve 51' are no longer aligned precisely with the gas inlet channel 17' and the liquid output channel 14', so that both gas inlet channel 17' and liquid output channel 14' are situated in an opened status, and the sliding sleeve reset spring 52' is also situated in a compressed energy storage status. Since the moving distance of the limit lug 212' of the press handle 21' is limited by the shallow arc groove 322', the moving distance is smaller, the water input space is smaller, and the water flow is smaller. During the operation of the water supply channel, a negative pressure is formed in the water outlet channel 13' to drain the concentrated liquid out from the container 7', and the concentrated liquid passes through the whole of the liquid outlet hole 412' of the proportional regulator 41' and along the base chamber 15', and then flows into the water outlet channel 13' through the liquid output channel 14', and finally the concentrated liquid is mixed with water to form a small-flow high-ratio dilute liquid to be sprayed out from the nozzle 64'. In this operation mode, the water input space is smaller, the flow is smaller, and the proportional regulator 41' for outputting the chemical concentrated liquid is situated in a fully opened status, so that the quantity of concentrated liquid mixed with water is greater, and the concentration of the mixed solution is higher. In other words, the ratio of the chemical concentrated liquid to water is large, and the dispenser is situated in a small-flow high-concentration operation mode. Similarly, the locking element 8' can lock the press handle 21' to achieve the effect of maintaining the continuous liquid output status of the dispenser. On the other hand, the effect of restoring the press handle 21' to its original position can be achieved.

Figure 23A:
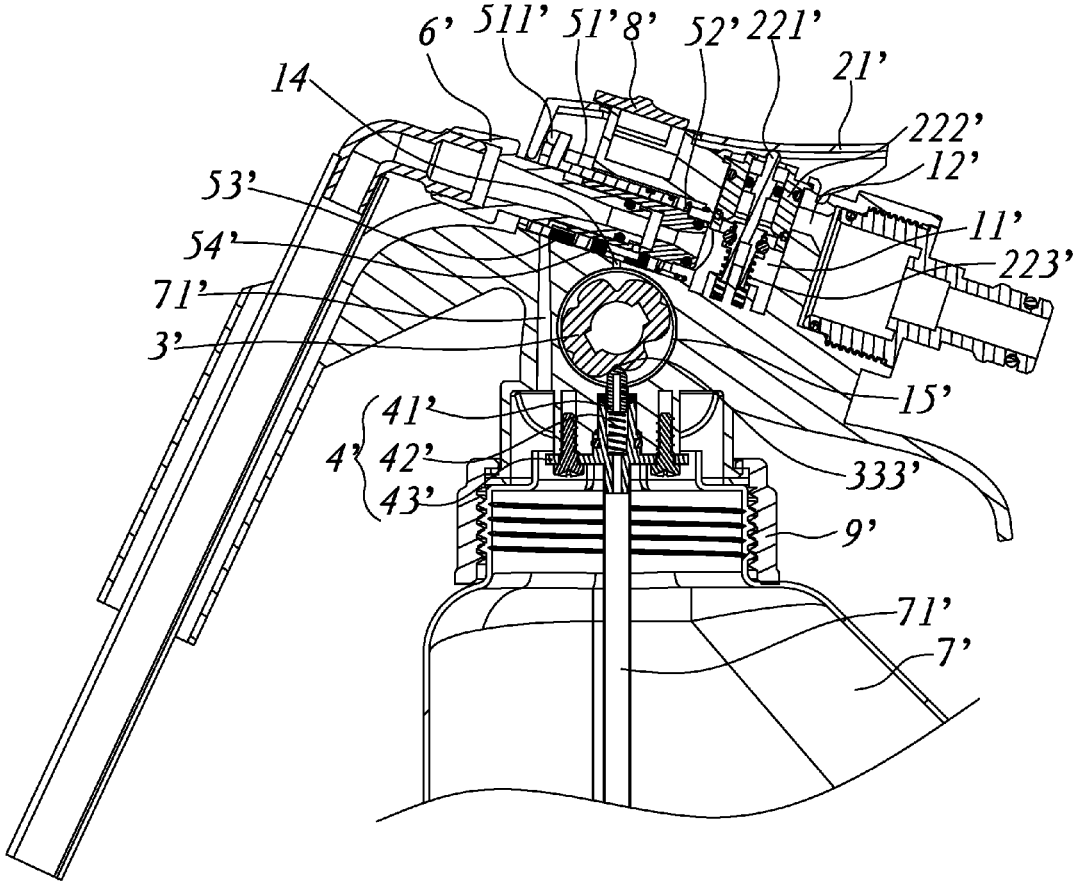
FIG. 23A is a sectional view, showing the position of a valve plug element (in a large-flow low-concentration status) of the second preferred embodiment of the present invention.
Figure 23B:
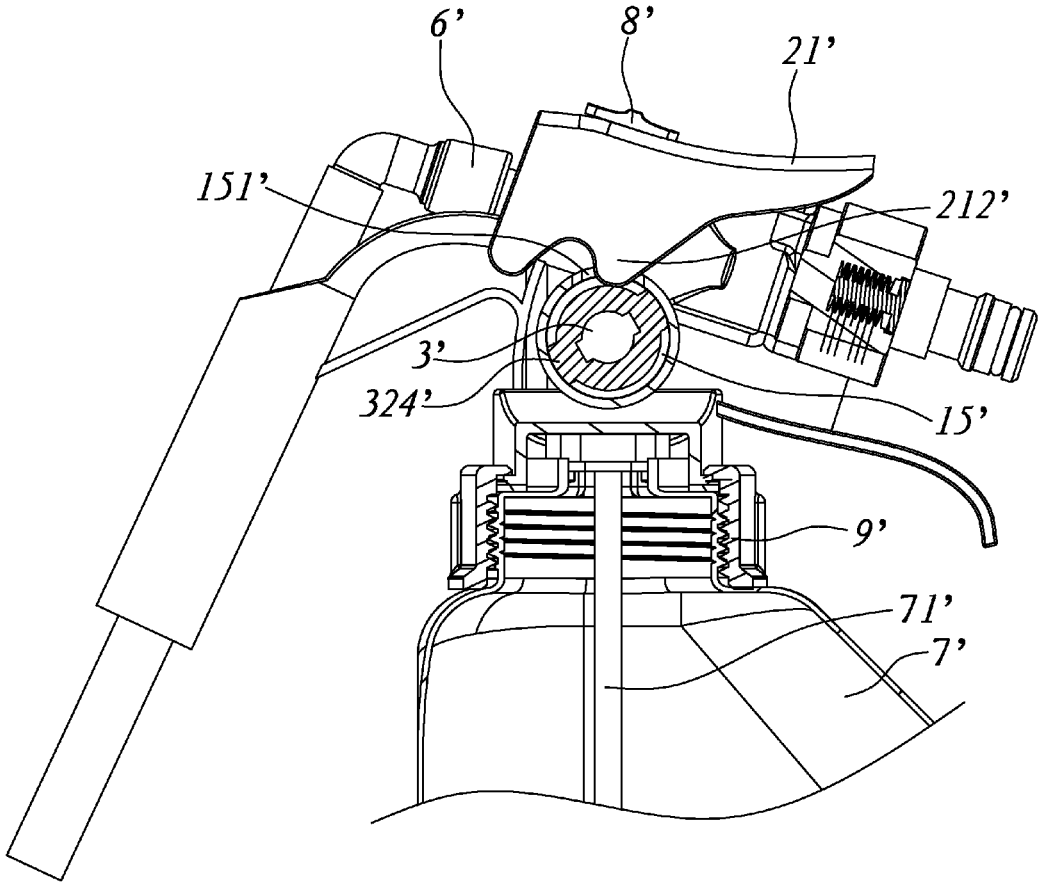
FIG. 23B is a sectional view, showing the position of a valve track (in a large-flow low-concentration status) of the second preferred embodiment of the present invention.

In FIGS. 23A and 23B, when the knob 31' for rotating the regulating device 3' is set to a large-flow low-concentration status, the deep arc groove 323' of the valve track 32' is disposed at the position of the notch 151' formed on the top of the base chamber 15'. In the meantime, a shallow slot 332' of the proportional controller track 33' is disposed on the bottom of the base chamber 15' and at a position opposite to the liquid input channel 16', and the top of the proportional regulator 41' abuts the shallow slot 332', and a portion of the liquid outlet hole 412' of the proportional regulator 41' is extended into the base chamber 15', and the liquid supply channel is situated in a semi-opened status. Now, the press handle 21' can be pressed to push the bolt shaft 221' to move downward, so as to open the water supply channel of the dispenser, and the restoring spring 223' is situated in a compressed energy storage status. The press handle 21' synchronously drives the sliding sleeve 51' to move backward, and the air hole gasket 53' and the liquid outlet gasket 54' on the sliding sleeve 51' are no longer aligned precisely with the gas inlet channel 17' and the liquid output channel 14', so that both gas inlet channel 17' and liquid output channel 14' are situated in an opened status, and the sliding sleeve reset spring 52' is also situated in a compressed energy storage status. Since the moving distance of the limit lug 212' of the press handle 21' is limited by the deep arc groove 323', the moving distance is greater, and the water input space is greater. During the operation of the water supply channel, a negative pressure is formed in the water outlet channel 13' to drain the concentrated liquid out from the container 7', and the concentrated liquid passes through a portion of the liquid outlet hole 412' of the proportional regulator 41' and along the base chamber 15' and then flows into the water outlet channel 13' through the liquid output channel 14', and finally the concentrated liquid is mixed with water to form a small-flow low-ratio dilute liquid to be sprayed out from the nozzle 64'. In this operation mode, the water input space is larger, the flow is larger, and the proportional regulator 41' for outputting the chemical concentrated liquid is situated in the semi-opened status, so that the quantity of concentrated liquid mixed with water is smaller, so that the concentration of the mixed solution is lower. In other words, the ratio of the chemical concentrated liquid to water is smaller, and the dispenser is situated in a large-flow low-concentration operation mode. Similarly, the locking element 8' can lock the press handle 21' to achieve the effect of maintaining the continuous liquid output status of the dispenser. On the other hand, the effect of restoring the press handle 21' to its original position can be achieved.

Figure 24A:
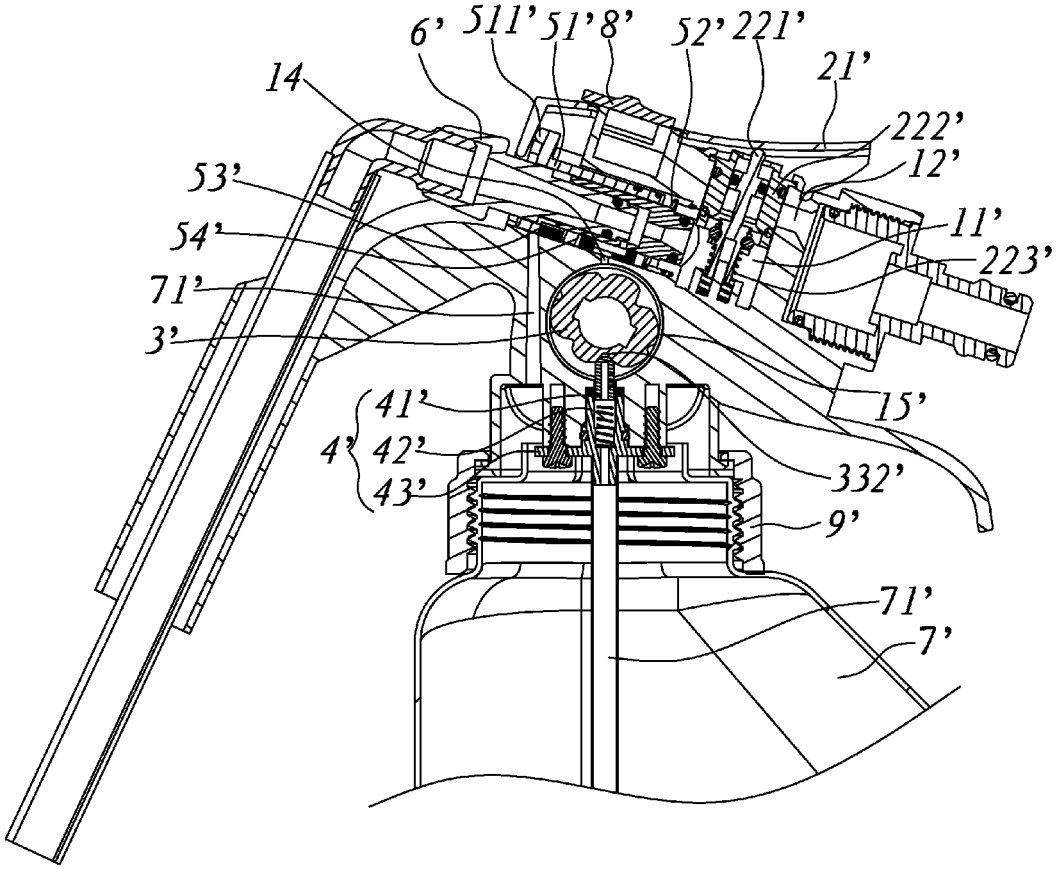
FIG. 24A is a sectional view, showing the position of a valve plug element (in a large-flow high-concentration status) of the second preferred embodiment of the present invention.
Figure 24B:
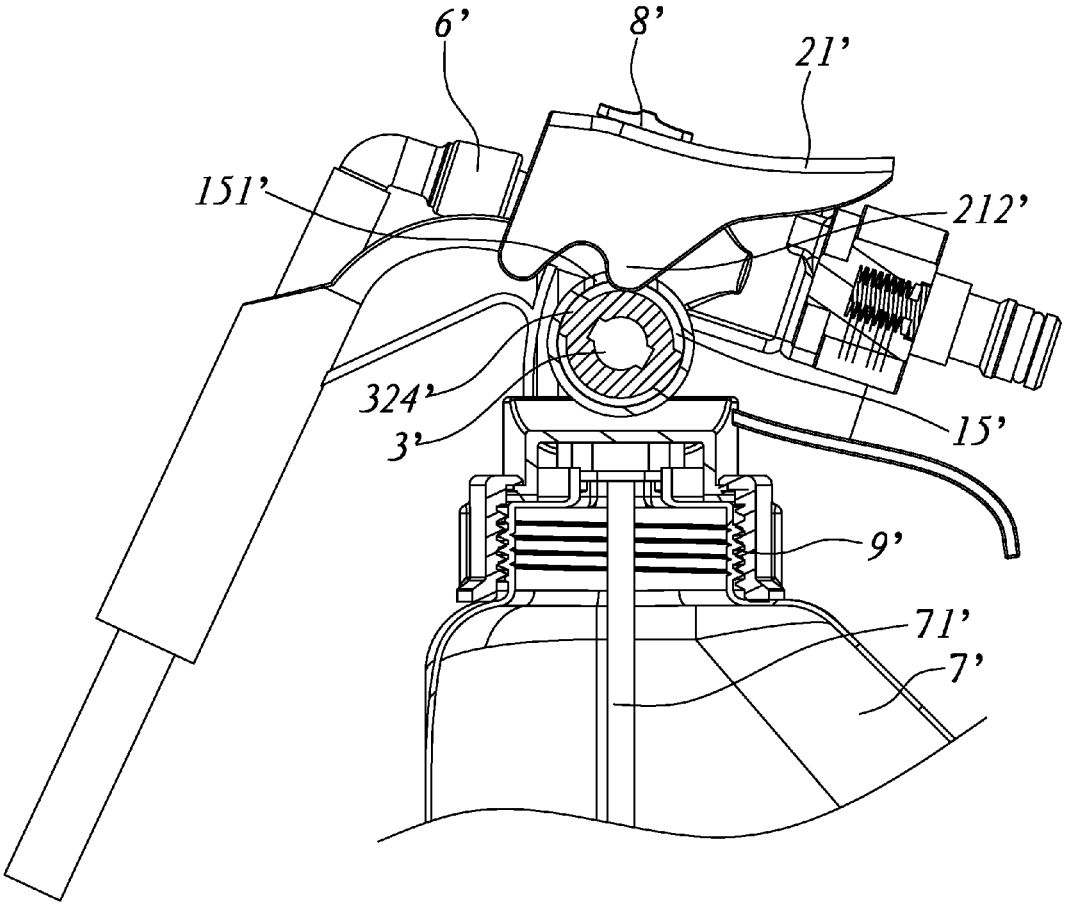
FIG. 24B is a sectional view, showing the position of a valve track (in a large-flow high-concentration status) of the second preferred embodiment of the present invention.

In FIGS. 24A and 24B, when the knob 31' for rotating the regulating device 3' is set to a large-flow high-concentration status, the shallow arc groove 322' of the valve track 32' is disposed at the position of the notch 151' formed on the top of the base chamber 15'. In the meantime, another deep slot 333' of the proportional controller track 33' is disposed on the bottom of the base chamber 15' and at a position opposite to the liquid input channel 16', and the top of the proportional regulator 41' abuts the deep slot 333', and the whole of the liquid outlet hole 412' of the proportional regulator 41' is extended into the base chamber 15', and the liquid supply channel is situated in a fully opened status. Now, the press handle 21' can be pressed to push the bolt shaft 221' to move downward, so as to open the water supply channel of the dispenser, and the restoring spring 223' is situated in a compressed energy storage status. The press handle 21' synchronously drives the sliding sleeve 51' to move backward, and the air hole gasket 53' and the liquid outlet gasket 54' on the sliding sleeve 51' are no longer aligned precisely with the gas inlet channel 17' and the liquid output channel 14', so that both gas inlet channel 17' and liquid output channel 14' are situated in an opened status, and the sliding sleeve reset spring 52' is also situated in a compressed energy storage status. Since the moving distance of the limit lug 212' of the press handle 21' is limited by the deep arc groove 323', the moving distance is greater, the water input space is greater, and the water flow is greater. During the operation of the water supply channel, a negative pressure is formed in the water outlet channel 13' to drain the concentrated liquid out from the container 7', and the concentrated liquid passes through the whole of the liquid outlet hole 412' of the proportional regulator 41' and along the base chamber 15', and then flows into the water outlet channel 13' through the liquid output channel 14', and finally the concentrated liquid is mixed with water to form a large-flow high-ratio dilute liquid to be sprayed out from the nozzle 64'. In this operation mode, the water input space is large, the flow is large, and the proportional regulator 41' for outputting the chemical concentrated liquid is situated in a fully opened status, so that the quantity of concentrated liquid mixed with water is greater, and the concentration of the mixed solution is higher. In other words, the ratio of the chemical concentrated liquid to water is great, and the dispenser is situated in a large-flow high-concentration operation mode. Similarly, the locking element 8' can lock the press handle 21' to achieve the effect of maintaining the continuous liquid output status of the dispenser. On the other hand, the effect of restoring the press handle 21' to its original position can be achieved.

In summation of the description above, the dispenser of the present invention can set an ON/OFF status of the dispenser by means of the regulating device 3 having the valve track 32 and the proportional controller track 33 to achieve the effects of outputting water only and with different flows and concentration ratios. The regulating device 3 limits the control valve 2 to open or not to open the water supply channel and to determine the quantity of flow while limiting the proportional control device 4 to control the quantity of concentrated liquid to be outputted, so as to achieve the effects of mixing a liquid (or water) with a chemical concentrate in a container accurately and distributing the mixed solution. As a result, mixtures of different concentrations can be obtained in both high-speed and low-speed flows to provide an accurate distribution function to meet the requirements for different occasions.

What is claimed is:

1. A multifunctional dispenser, comprising:

a main body, including a control valve, a regulating device, a proportional control device and a ventilation valve disposed thereon;

a connecting nozzle, disposed at the front of the main body; and a water supply pipe, coupled to the rear of the main body;

wherein the bottom of the main body is communicated with a draft tube in a concentrated liquid container through the proportional control device; the control valve is provided for determining a water flow condition of a water supply channel in the main body; the regulating device is a rotatable cylinder passing through the main body, and the cylinder has a valve track and a proportional controller track formed at positions corresponding to the control valve and the proportional control device respectively, and the valve track has a plurality of arc sections with unequal depths for limiting a stroke of the control valve, and the proportional controller track is in a wavy shape comprised of a plurality of grooves with unequal depths; and a proportional regulator of the proportional control device abuts against the proportional controller track through a reset spring, and the proportional regulator having a plurality of liquid outlet holes together with different grooves formed on the proportional controller track are provided for determining the flow of concentrated liquid outputted from the main body; and the main body further includes a ventilation valve for controlling of the control valve to determine whether or not to open a gas inlet channel.

2. The multifunctional dispenser of claim 1, wherein the main body includes a valve chamber formed in a longitudinal direction and corresponding to the control valve, and both sides of the valve chamber are communicated and coupled to the a water inlet channel of the water supply pipe and a water outlet channel of the connecting nozzle respectively, and a liquid output channel is formed on a sidewall of the valve chamber under the water outlet channel, and a base chamber corresponding to the regulating device is communicated with the main body and formed at the bottom of the valve chamber, and a liquid input channel is formed at the bottom of the base chamber and communicated with the container under the main body, and the main body includes a gas inlet channel corresponding to the ventilation valve formed thereon and passing through the main body.

3. The multifunctional dispenser of claim 2, wherein the control valve includes a press handle pivotally coupled to the top of the main body, a valve plug element disposed at a corresponding position in the valve chamber and having a bolt shaft, a bolt seat for positioning the bolt shaft and a restoring spring, and after the valve plug element is assembled into the valve chamber of the main body, the bolt shaft is acted by the restoring spring to abut against a lower surface of the press handle.

4. The multifunctional dispenser of claim 3, wherein the front of the press handle is pivotally coupled to the main body at the front of the valve chamber, and a top pressing surface is disposed on the top of the press handle, and a corresponding slot is formed at the top pressing surface and provided for installing a locking element, and the bottom of the locking element is movably installed on the main body to define a locking relation with the press handle.

5. The multifunctional dispenser of claim 2, wherein the regulating device is the cylinder sealed in the base chamber of the main body, and a knob is formed at the front of the cylinder and extended out from the main body, and the cylinder at the rear of the knob is extended into the base chamber, and the cylinder includes the valve track and the proportional controller track at positions corresponding to a bolt shaft of the control valve and the proportional controller of the proportional control device respectively.

6. The multifunctional dispenser of claim 5, wherein the valve track has a sink slot formed in a radial direction along the cylinder, and a shallow arc groove, a deep arc groove and an outer arc section with an equal diameter of the base chamber formed at the external periphery of the cylinder.

7. The multifunctional dispenser of claim 6, wherein the proportional controller track has two deep slots, two shallow slots and two positioning slots formed in the radial direction along the cylinder.

8. The multifunctional dispenser of claim 1, wherein the proportional control device includes the proportional regulator, the reset spring and a connecting base, and the proportional regulator and the reset spring are disposed in the connecting base and communicated with the draft tube, and the proportional regulator is a bullet head having a sink hole, and a plurality of liquid outlet holes formed in a longitudinal direction on a sidewall of the proportional regulator and communicated with the sink hole.

9. The multifunctional dispenser of claim 2, wherein the ventilation valve includes a valve stem and a valve stem restoring spring, and a ventilation slot is formed on a sidewall of the valve stem, and the bottom of the valve stem corresponding to the sealing member constitutes a sealing relation with the top of the gas inlet channel.

10. The multifunctional dispenser of claim 2, wherein the connecting nozzle includes a connecting pipe, a water mixing base, a locking sleeve and a nozzle, and the rear of the connecting pipe has a water outlet and a liquid outlet coupled to a water outlet channel and a liquid output channel of the main body respectively, and the front of the connecting pipe is disposed in the water mixing base and coupled to the nozzle, and the locking sleeve is provided for locking the connecting pipe and the water mixing base onto the main body.

11. The multifunctional dispenser of claim 1, wherein the main body has a valve chamber formed downwardly from the top of the main body and corresponding to the control valve, and both sides of the valve chamber are communicated and coupled to a water inlet channel of the water supply pipe and a water outlet channel of the connecting nozzle, and the main body at the bottom of the water outlet channel has a base chamber formed in a transverse direction and corresponding to the regulating device, and the top of the base chamber has a liquid output channel communicated with the water outlet channel, and a liquid input channel is formed at the bottom of the base chamber and communicated with the container, and a notch is formed at the top of an external side of the base chamber, and the main body has the ventilation valve formed in a longitudinal direction opposite to the front of the base chamber and passing through a gas inlet channel of the main body.

12. The multifunctional dispenser of claim 11, wherein the control valve includes a press handle pivotally coupled to the top of the main body, a valve plug element disposed in the valve chamber, and including a bolt shaft, a bolt seat for positioning the bolt shaft and a restoring spring, and after the valve plug element is assembled into the valve chamber of the main body, the bolt shaft is acted by the restoring spring to abut against a lower surface of the press handle.

13. The multifunctional dispenser of claim 12, wherein the bottom of the front of the press handle is pivotally coupled to the main body at the front of the base chamber, and a top pressing surface is formed at the top of the press handle, and the top pressing surface has a corresponding slot provided for installing a locking element, and the bottom of the locking element is movably installed on the main body to define a locking relation with the press handle, and both sides of the press handle have a limit lug aligned precisely with the notch at the top of the base chamber of the main body.

14. The multifunctional dispenser of claim 11, wherein the regulating device is the cylinder sealed in the base chamber of the main body, and a knob is formed at the front of the cylinder and extended out from the main body, and the cylinder at the rear of the knob is extended into the base chamber, and the cylinder has the valve track and the proportional controller track disposed at positions corresponding to the limit lug of the control valve and a proportional controller of the proportional control device respectively.

15. The multifunctional dispenser of claim 1, wherein the valve track is disposed adjacent to the knob and has a shallow arc groove, a deep arc groove and an outer arc section with the same diameter of the base chamber formed at the external periphery of the cylinder.

16. The multifunctional dispenser of claim 14, wherein the valve track is disposed adjacent to the knob and has a shallow arc groove, a deep arc groove and an outer arc section with the same diameter of the base chamber formed at the external periphery of the cylinder.

17. The multifunctional dispenser of claim 1, wherein the ventilation valve includes a sliding sleeve installed in the water outlet channel, a sliding sleeve spring, and an air hole gasket and a liquid outlet gasket installed on the sliding sleeve and corresponding to the gas inlet channel and the liquid output channel of the main body respectively, and the sliding sleeve and the press handle are integrated with each other, and operated with the press handle.

18. The multifunctional dispenser of claim 11, wherein the ventilation valve includes a sliding sleeve installed in the water outlet channel, a sliding sleeve spring, and an air hole gasket and a liquid outlet gasket installed on the sliding sleeve and corresponding to the gas inlet channel and the liquid output channel of the main body respectively, and the sliding sleeve and the press handle are integrated with each other, and operated with the press handle.

19. The multifunctional dispenser of claim 16, further comprising a hook formed at the top of the front of the sliding sleeve and integrated with the front of the press handle.

* * * * *